US010573325B2

(12) United States Patent
Yamamoto et al.

(10) Patent No.: US 10,573,325 B2
(45) Date of Patent: Feb. 25, 2020

(54) DECODING DEVICE, DECODING METHOD, AND PROGRAM

(71) Applicant: Sony Corporation, Tokyo (JP)

(72) Inventors: Yuki Yamamoto, Tokyo (JP); Toru Chinen, Kanagawa (JP); Runyu Shi, Kanagawa (JP); Mitsuhiro Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/319,855

(22) PCT Filed: Jun. 16, 2015

(86) PCT No.: PCT/JP2015/002992

§ 371 (c)(1),
(2) Date: Dec. 19, 2016

(87) PCT Pub. No.: WO2015/198556

PCT Pub. Date: Dec. 30, 2015

(65) Prior Publication Data

US 2017/0140763 A1 May 18, 2017

(30) Foreign Application Priority Data

Jun. 26, 2014 (JP) ..... 2014-130898

(51) Int. Cl.
*G10L 19/008* (2013.01)
*G10L 19/16* (2013.01)
*G10L 19/20* (2013.01)

(52) U.S. Cl.
CPC ..... *G10L 19/008* (2013.01); *G10L 19/167* (2013.01); *G10L 19/20* (2013.01)

(58) Field of Classification Search
CPC ..... G10L 19/008; G10L 19/20; G10L 19/167
(Continued)

(56) References Cited

U.S. PATENT DOCUMENTS

2005/0058145 A1* 3/2005 Florencio ..... G10L 19/005 370/412
2005/0096918 A1* 5/2005 Rao ..... G10L 19/16 704/500
(Continued)

FOREIGN PATENT DOCUMENTS

JP 2001-134294 A 5/2001
JP 2002-156998 A 5/2002
(Continued)

OTHER PUBLICATIONS

European Communication Pursuant to Article 94(3) dated Jan. 2, 2019 in connection with European Application No. 15734263.5.
(Continued)

*Primary Examiner* — Bharatkumar S Shah
(74) *Attorney, Agent, or Firm* — Wolf, Greenfield & Sacks, P.C.

(57) ABSTRACT

There is provided a decoding device comprising at least one buffer and at least one processor. The at least one processor is configured to select, based at least in part on a size of the at least one buffer, at least one audio element from among multiple audio elements in an input bit stream; and generate an audio signal by decoding the at least one audio element.

12 Claims, 17 Drawing Sheets

(58) Field of Classification Search
USPC ..... 700/500
See application file for complete search history.

(56) References Cited

U.S. PATENT DOCUMENTS

| | | | | |
|---|---|---|---|---|
| 2006/0268354 | A1* | 11/2006 | Rodgers | H04N 9/7921 358/425 |
| 2012/0230497 | A1* | 9/2012 | Dressler | H04S 3/02 381/22 |
| 2013/0202129 | A1* | 8/2013 | Kraemer | G10L 19/00 381/77 |

FOREIGN PATENT DOCUMENTS

| | | | |
|---|---|---|---|
| JP | 2004-165776 | A | 6/2004 |
| JP | 2012-042972 | A | 3/2012 |

OTHER PUBLICATIONS

[No Author Listed], subpart 4: General audio coding (GA)—AAC, TwinVQ, BSAC. ISO/IEC 14496-3:200x, Fourth Edition, part 4, 82. MPEG meeting; Oct. 22, 2007-Oct. 26, 2007; Shenzhen; (Motion Picture Expert Group or ISO/IEC JTC1/SC29/WG11), May 15, 2009; 405 pages.

* cited by examiner

DECODING DEVICE, DECODING METHOD, AND PROGRAM

CROSS-REFERENCE TO RELATED APPLICATIONS

This application is a National Stage of International Application No. PCT/JP2015/002992, filed in the Japanese Patent Office as a Receiving office on Jun. 16, 2015, which claims priority to Japanese Patent Application Number 2014-130898, filed in the Japanese Patent Office on Jun. 26, 2014, the entire contents of which are incorporated herein by reference.

TECHNICAL FIELD

The present technology relates to a decoding device, a decoding method, and a program. In particular, the present technology relates to a decoding device, a decoding method, and a program capable of decoding bit streams in apparatuses having different hardware scales.

BACKGROUND ART

As an encoding technique for performing reproduction for high realistic sensation superior to the 5.1-channel surround reproduction in the related art or transferring a plurality of audio elements (objects), the 3D audio standard has been generally used (for example, refer to NPL 1 to 3).

In the 3D audio standard, the minimum value of the size of the buffer for storing the input bit stream to be provided to a decoder is defined as a minimum decoder input buffer size. For example, in the section 4.5.3.1 in NPL 3, the minimum decoder input buffer size is defined to be equal to 6144*NCC (bits).

Here, NCC is an abbreviation of Number of Considered Channel, and indicates the sum between twice the number of channel pair elements (CPEs) and the number of single channel elements (SCEs), in all the audio elements included in the input bit stream.

Further, SCE is an audio element in which an audio signal of one channel is stored, and CPE is an audio element in which an audio signal of two channels set as a pair is stored. Consequently, for example, the number of SCEs included in an input bit stream may be 5, and the number of CPEs may be 3. In this case, NCC=5+2*3=11.

As described above, in the 3D audio standard, when the decoder is intended to decode the input bit stream, it is necessary to ensure the minimum buffer with the defined size.

CITATION LIST

Non Patent Literature

NPL 1: ISO/IEC JTC1/SC29/WG11 N14459, April 2014, Valencia, Spain, "Text of ISO/IEC 23008-3/CD, 3D audio"

NPL 2: INTERNATIONAL STANDARD ISO/IEC 23003-3 First edition 2012-04-01 Information technology-coding of audio-visual objects-part3: Unified speech and audio coding NPL 3: INTERNATIONAL STANDARD ISO/IEC 14496-3 Fourth edition 2009-09-01 Information technology-coding of audio-visual objects-part3: Audio

SUMMARY OF INVENTION

Technical Problem

However, in the 3D audio standard in NPL 1, the number of SCEs and the number of CPEs are substantially arbitrarily set. Hence, in order to decode all the bit streams prescribed by the 3D audio standard, the minimum decoder input buffer size to be provided to a decoder is much larger than that in the standard in NPL 3.

Specifically, in the 3D audio standard in NPL 1, the sum between the number of SCEs and the number of CPEs can be set to be maximum 65805. Accordingly, the maximum value of the minimum decoder input buffer size is represented by the following expression: maximum value of minimum decoder input buffer size=6144*(0+65805*2)=808611840 (bits), and is equal to approximately 100 MByte.

As described above, when the minimum decoder input buffer size as a minimum necessary buffer size is large, it may be difficult for a platform with a small memory size to ensure the buffer with the defined size. That is, in accordance with the hardware scale of the apparatus, it may be difficult for the decoder to be mounted.

It is desirable to decode bit streams in apparatuses having different hardware scales.

Solution to Problem

Some embodiments are directed to a decoding device. The decoding device comprises at least one buffer; and at least one processor configured to: select, based at least in part on a size of the at least one buffer, at least one audio element from among multiple audio elements in an input bit stream; and generate an audio signal by decoding the at least one audio element.

Some embodiments are directed to a decoding method. The method comprises selecting, based at least in part on a size of at least one buffer of a decoding device, at least one audio element from among multiple audio elements in an input bit stream; and generating an audio signal by decoding the at least one audio element.

Some embodiments are directed to at least one non-transitory computer-readable storage medium storing processor-executable instructions that, when executed by at least one processor, cause the at least one processor to perform a decoding method. The decoding method comprises selecting, based at least in part on a size of at least one buffer of a decoding device, at least one audio element from among multiple audio elements in an input bit stream; and generating an audio signal by decoding the at least one audio element.

Advantageous Effects of Invention

According to the embodiments of the present technology, it is possible to decode bit streams in apparatuses having different hardware scales.

It should be noted that the effect described herein is not necessarily limited, and may be either one of the effects described in the present disclosure.

DESCRIPTION OF EMBODIMENTS

Hereinafter, referring to drawings, embodiments, to which the present technology is applied, will be described.

First Embodiment

In an embodiment of the present technology, decoders having various allowable memory sizes, that is, various apparatuses having different hardware scales, are able to decode the input bit stream in which an encoded multi-channel audio signal is stored.

In the embodiment of the present technology, a plurality of combinations of audio elements in the input bit stream is defined in the input bit stream, and by changing the minimum value of a size of a buffer in which the input bit stream to be provided to the decoder is stored for each combination of the audio elements, it is possible to perform decoding in a different hardware scale.

First, a brief overview of the embodiment of the present technology will be described.

<Additional Definitions about Combination of Audio Elements>

In the embodiment of the present technology, in the 3D audio standard, a plurality of combinations of audio elements can be defined. Here, the plurality of combinations is defined such that the input bit stream can be decoded by the decoders with various allowable memory sizes.

Figure 1:
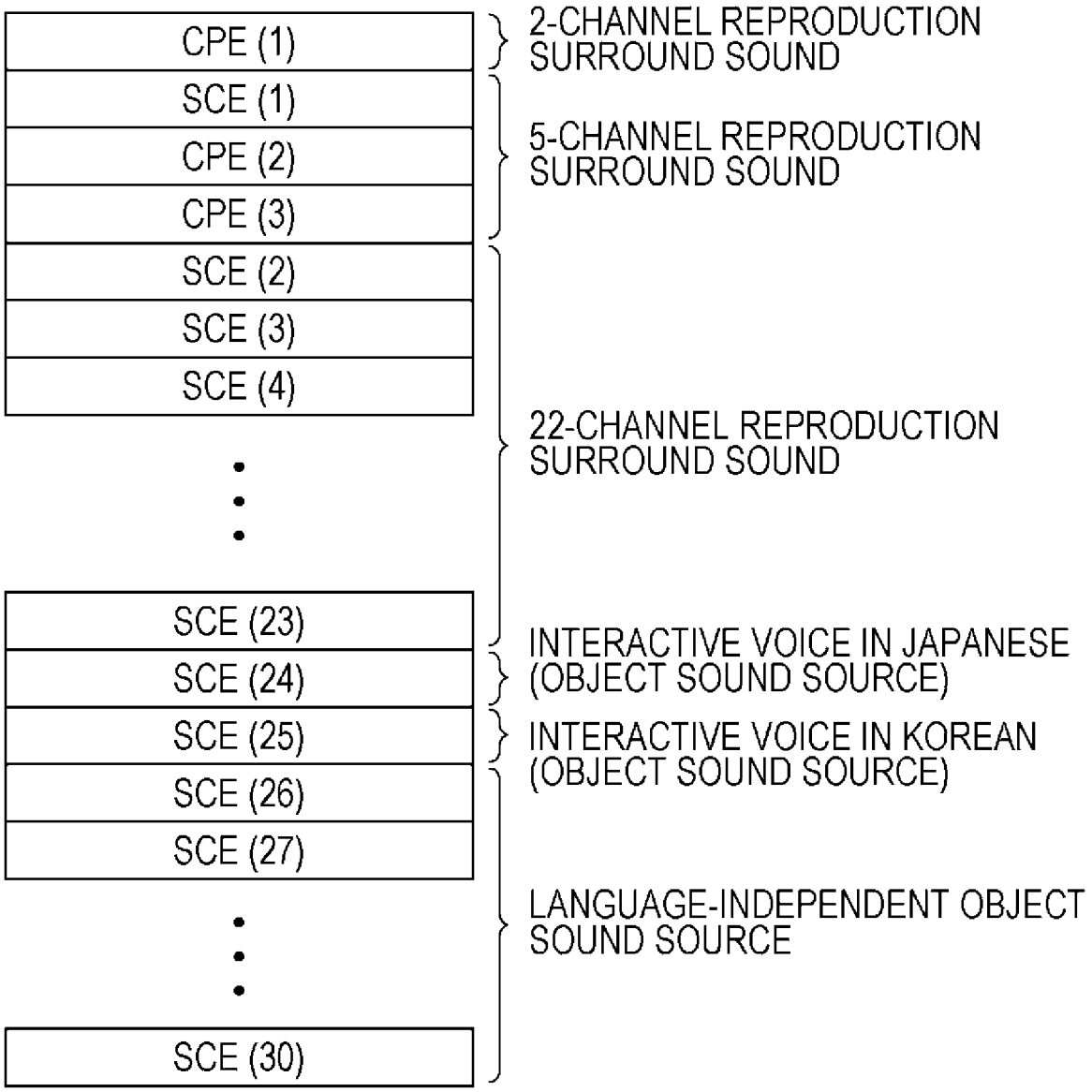
FIG. 1 is a diagram illustrating a configuration of an input bit stream.

For example, the input bit stream for reproducing one content is constituted of audio elements shown in FIG. 1. It should be noted that, in the drawings, one rectangle indicates one audio element constituting an input bit stream. Further, the audio element, which is denoted by SCE(i) (here, i is an integer), indicates an i-th SCE, and the audio element, which is denoted by CPE(i) (here, i is an integer), indicates an i-th CPE.

As described above, SCE is data which is necessary for decoding an audio signal for one channel, that is, an audio element in which encoded data obtained by encoding the audio signal for one channel is stored. Further, CPE is data which is necessary for decoding an audio signal for two channels set as a pair.

In FIG. 1, CPE(1) is an audio element in which a surround sound for 2-channel reproduction is stored. Hereinafter, a group of an element formed of CPE(1) is also referred to as a channel sound source group 1.

Further, SCE(1), CPE(2), and CPE(3) are audio elements in which surround sounds for 5-channel reproduction are stored. Hereinafter, a group of elements formed of SCE(1), CPE(2), and CPE(3) is also referred to as a channel sound source group 2.

SCE(2) to SCE(23) are audio elements in which surround sounds for 22-channel reproduction are stored. Hereinafter, a group of elements formed of SCE(2) to SCE(23) is also referred to as a channel sound source group 3.

SCE(24) is an audio element in which an interactive voice of a predetermined language such as Japanese as an object (sound material) is stored. Hereinafter, a group of an element formed of SCE(24) is also referred to as an object sound source group 1. Likewise, SCE(25) is an audio element in which an interactive voice of Korean as an object is stored. Hereinafter, a group of an element formed of SCE(25) is also referred to as an object sound source group 2.

Furthermore, SCE(26) to SCE(30) are audio elements in which sounds of a vehicle sound and the like objects are stored. Hereinafter, a group of elements formed of SCE(26) to SCE(30) is also referred to as an object sound source group 3.

When the contents are intended to be reproduced by decoding the input bit stream, the channel sound source groups 1 to 3 and the object sound source groups 1 to 3 can be arbitrarily combined, and the content can be reproduced.

In such a case, in the example of FIG. 1, the combinations of audio elements of the channel sound source groups and the object sound source groups are the following six combinations CM(1) to CM(6).

Combination CM(1)

Channel Sound Source Group 1, Object Sound Source Group 1, Object Sound Source Group 3

Combination CM(2)

Channel Sound Source Group 1, Object Sound Source Group 2, Object Sound Source Group 3

Combination CM(3)

Channel Sound Source Group 2, Object Sound Source Group 1, Object Sound Source Group 3

Combination CM(4)

Channel Sound Source Group 2, Object Sound Source Group 2, Object Sound Source Group 3

Combination CM(5)

Channel Sound Source Group 3, Object Sound Source Group 1, Object Sound Source Group 3

Combination CM(6)

Channel Sound Source Group 3, Object Sound Source Group 2, Object Sound Source Group 3

These combinations CM(1) to CM(6) are set as combinations of the audio elements for reproducing the contents by 2-channel Japanese, 2-channel Korean, 5-channel Japanese, 5-channel Korean, 22-channel Japanese, and 22-channel Korean, respectively.

In this case, a relationship of magnitudes of the memory sizes of the decoder necessary for the respective combinations is as follows.

Combination CM(1), CM(2)<Combination CM(3), CM(4)<Combination CM(5), CM(6)

These combinations of the audio elements can be implemented by defining the combinations as bit stream syntax.

<Amendment of Definition of Minimum Decoder Input Buffer>

However, in the 3D audio standard, by amending a current rule described below so as to change the minimum decoder input buffer size for each of the above-mentioned combinations, the input bit stream can be decoded by decoders with various allowable memory sizes.

<Current Rule>

Minimum Decoder Input Buffer Size=6144*NCC (bits)

As described above, NCC indicates the sum between twice the number of CPEs and the number of SCEs among all the audio elements included in the input bit stream. In the current state, it is assumed that an apparatus has a self-allowable memory size, that is, a maximum allocable buffer size less than the minimum decoder input buffer size (hereinafter also referred to as a necessary buffer size). In the apparatus, even when it is possible to ensure a sufficient buffer size only for a predetermined combination, it is difficult to decode the input bit stream.

Therefore, in the embodiment of the present technology, by performing the following amendment AM1 or amendment AM2, in accordance with the self-hardware scales, that is, the allowable memory sizes, the apparatuses are able to decode and reproduce the contents (input bit stream) by using the combinations of the audio elements appropriate for themselves.

<Amendment AM1>

In the rule prescribed by the 3D audio standard, NCC is the sum between twice the number of CPEs and the number of SCEs among all the audio elements included in the input bit stream. Instead of this, NCC is the sum between twice the number of CPEs and the number of SCEs among all the audio elements which are included in combinations of the audio elements as decoding targets included in the input bit stream.

<Amendment AM2>

The minimum decoder input buffer size (necessary buffer size) for each of combinations of the audio elements is defined as the bit stream syntax.

By performing the amendment AM1 or AM2, it is possible to decode the input bit stream even in an apparatus having a smaller allowable memory size on the decoder side. Hence, the following amendments are necessary for the decoder side and the encoder side.

<Amendment of Signal Processing of Decoder>

By comparing the self-allowable memory size with the size (necessary buffer size) of each of the combinations of the audio elements in the input bit stream, the decoder specifies the combinations of the audio elements satisfying a condition in which "self-allowable memory size is equal to or greater than the size of each combination", and decodes the audio elements of any of the combinations satisfying the condition.

Here, a method of specifying the necessary buffer size of each of the combinations of the audio elements may be applied either the amendment AM1 or the amendment AM2.

That is, in a case of applying the amendment AM1, for example, the decoder may specify the combinations of the audio elements from information which is stored in the acquired input bit stream, and may calculate the necessary buffer size of each combination of the audio elements. Further, in a case of applying the amendment AM2, the decoder may read the necessary buffer size of each of the combinations of the audio elements from the input bit stream.

The combination of the audio elements as a decoding target may be a combination, which is specified by a user, among the combinations of which the necessary buffer sizes are equal to or less than the allowable memory size. Further, the combination of the audio elements as a decoding target may be a combination, which is selected by predetermined setting, among the combinations of which the necessary buffer sizes are equal to or less than the allowable memory size.

Hereinafter, the condition, in which the necessary buffer size for the combination of the audio elements is equal to or less than the allowable memory size, is referred to as a buffer size condition.

The combination of the audio elements as a decoding target may be selected before the input bit stream is acquired, and may be selected after the input bit stream is acquired. That is, the embodiment of the present technology can be applied to, for example, a push-type contents transfer system such as television broadcast, and can be applied to a pull-type contents transfer system typified by a moving picture experts group (MPEG)-dynamic adaptive streaming over HTTP (DASH) system.

<Amendment of Operation Rule of Encoder>

An encoder performs encoding by adjusting an amount of bits of the audio elements (encoded data) for each time frame so as to decode the amended minimum decoder input buffer size for each of all the combinations of the audio elements.

That is, even when the decoder selects a certain combination of the audio elements, the encoder performs encoding while adjusting the amount of bits allocated into the encoded data of each channel for each time frame so as to decode the audio elements when the buffer size of the decoder side is the necessary buffer size. Here, the phrase the audio elements can be decoded means that the decoding can be performed without causing both the overflow and the underflow in the buffer in which the audio elements of the combination set as a decoding target are stored.

As described above, by appropriately selecting the combinations of the audio elements in accordance with the necessary buffer size of each of the combinations of the audio elements on the decoder side, the input bit stream can be decoded by the decoders with various allowable memory sizes. That is, it is possible to decode the input bit stream in various apparatuses having different hardware scales.

<Reduction in Transfer Bit Rate Using Object Priority Information>

In a case of applying the embodiment of the present technology to the full-type contents transfer system, on the basis of meta data and the like, by selecting and acquiring only the necessary audio elements, it is possible to reduce the transfer bit rate of the input bit stream. In other words, by causing the decoder not to acquire the unnecessary audio elements, it is possible to reduce the transfer bit rate of the input bit stream.

Here, the full-type contents transfer service typified by MPEG-DASH is considered. In such a manner, the input bit stream for 3D audio is assigned to a server in, for example, either one of the following two methods of an assignment pattern (1) or an assignment pattern (2).

<Assignment Pattern (1)>

The entirety of the input bit stream for 3D audio is assigned as a single stream.

<Assignment Pattern (2)>

The input bit stream for 3D audio is divided and assigned for each of the combinations of the audio elements.

Specifically, in the assignment pattern (1), for example as shown in FIG. 1, audio elements of the all combinations, that is, a single input bit stream, is assigned to the server. The input bit stream includes audio elements constituting all the channel sound source groups and the object sound source groups.

In this case, for example, in information acquired from the server and the like in advance and information (meta data) stored in a header of the input bit stream, the decoder is able to perform decoding by selecting the combination of the audio elements as a decoding target and acquiring only the audio elements of the selected combination from the server. Further, once the decoder acquires the input bit stream, the decoder is able to perform decoding by selecting the necessary audio elements from the input bit stream.

In the example of the assignment pattern (1), for each transfer speed of the input bit stream, that is, for each transfer bit rate, the input bit stream may be provided and assigned to the server.

Figure 2:
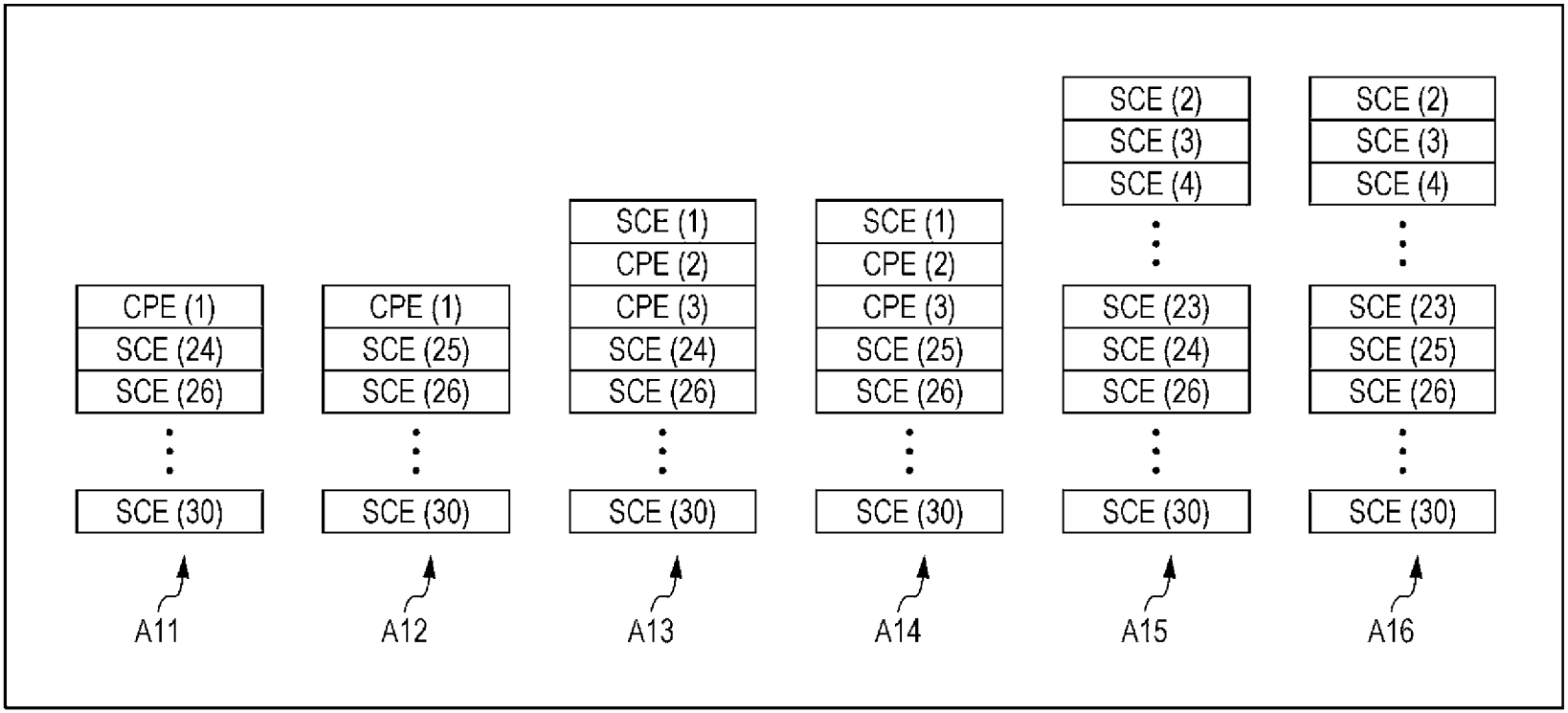
FIG. 2 is a diagram illustrating an assignment example of the input bit stream.

In the assignment pattern (2), the input bit stream shown in FIG. 1 is divided for each of the combinations of the audio elements, and for example as shown in FIG. 2, the bit stream of each combination which can be obtained by division is assigned to the server.

It should be noted that, in FIG. 2, in a manner similar to that of FIG. 1, one rectangle indicates one audio element, that is, SCE or CPE.

In this example, in the server, the bit stream formed of components of the combination CM(1) indicated by the arrow A11, the bit stream formed of components of the combination CM(2) indicated by the arrow A12, and the bit stream formed of components of the combination CM(3) indicated by the arrow A13 are assigned.

Further, in the server, the bit stream formed of components of the combination CM(4) indicated by the arrow A14, the bit stream formed of components of the combination CM(5) indicated by the arrow A15, and the bit stream of components of the combination CM(6) indicated by the arrow A16 are assigned.

In this case, the decoder performs decoding by selecting the combination of the audio elements as a decoding target from the information acquired from the server and the like and acquiring the audio elements of the selected combination from the server. It should be noted that, even in the example of the assignment pattern (2), the divided input bit streams may be provided for each transfer bit rate, and may be assigned to the server.

Further, the single input bit stream represented in the assignment pattern (1) may be divided when transmitted from the server to the decoder side, and the bit stream formed of only the audio elements of the requested combination may be transmitted.

When only the combination of the audio elements as a decoding target is acquired in such a manner, it is possible to reduce the transfer bit rate.

For example, if only the combination of the audio elements as a decoding target is acquired from the decoder side, on the basis of the meta data in which the input bit stream is stored and the like, the combination of the audio elements can be selected. Here, the combination of the audio elements is selected on the basis of, for example, the information which is stored as meta data in the input bit stream and which represents combinations of the audio elements that can be acquired from the input bit stream.

In addition to this, if the decoder is made not to acquire the unnecessary audio elements among audio elements of the combination as a decoding target, it is possible to further reduce the transfer bit rate. For example, these unnecessary audio elements may be designated by a user, and may be selected on the basis of the meta data, which is stored in the input bit stream, and the like.

In particular, if the unnecessary audio elements are selected on the basis of the meta data, the selection may be performed on the basis of priority information. The priority information represents the priorities (importance degrees) of the objects, that is, the priorities of the audio elements. Here, the priority information indicates that, as the value of the priority information is larger, the priority of the audio element is higher, and the element is more important.

For example, in the 3D audio standard, for each object sound source, for each time frame, the object priority information (object_priority) is defined in the input bit stream, and more specifically defined inside an EXT element. Particularly, in the 3D audio standard, the EXT element is defined in a syntax layer which is the same as that of SCE or CPE.

Therefore, a client to reproduce the contents, that is, the decoder, reads the object priority information, and issues a command to the server such that the server does not transfer the audio elements of the objects of which the values are equal to or less than a threshold value determined in advance in the client. Thereby, the input bit stream (data) transmitted from the server can be made not to include the audio elements (SCEs) of an object sound source designated by the command, and thus it is possible to reduce the bit rate of the transfer data.

In order to achieve reduction of the transfer bit rate using the priority information, the following two processes are necessary: prefetching of the object priority information; and the transfer bit rate adjustment process for performing decoding with the amended minimum decoder input buffer size.

<Prefetching of Priority Information>

In order for the client (decoder) to request the server not to transfer the audio element of the specific object, the client has to read the object priority information before the audio elements of the object sound source are transferred.

As described above, in the 3D audio standard, each object priority information is included in the EXT element. Consequently, in order to prefetch the object priority information, for example, the EXT elements may be assigned at the following assigned positions A(1) and A(2). It should be noted that, although not limited to such an example, if the priority information can be prefetched, the assigned position of the EXT element, that is, the priority information, may be any position, and may be acquired in any method.

<Assigned Position A(1)>

The EXT element is provided as a single file, and thus the client reads the object priority information corresponding to all frames or several prefectched frames at the start of the decoding.

<Assigned Position A(2)>

The EXT element is assigned to the head of the frames in the bit stream, and the client reads the object priority information for each time frame.

Figure 3:
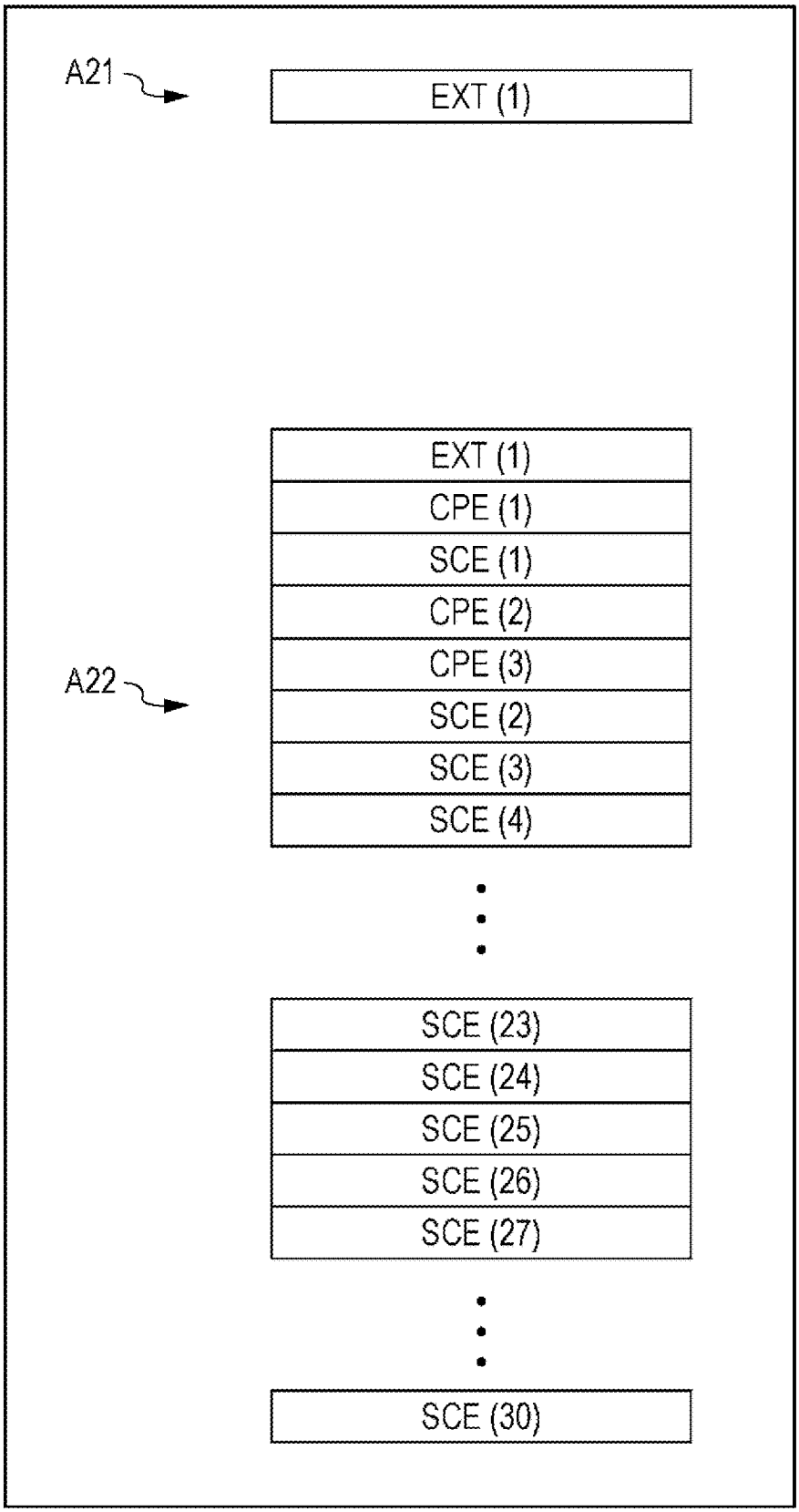
FIG. 3 is a diagram illustrating priority information.

For example, in the assigned position A(1), for example as indicated by the arrow A21 of FIG. 3, a single file (EXT element) is recorded in the server. In the file, the priority information for each time frame of all the objects constituting the contents, that is, the audio elements of all the objects, is stored.

In FIG. 3, a single rectangle, in which the text "EXT(1)" is written, indicates a single EXT element. In this example, the client (decoder) acquires the EXT elements from the server at an arbitrary timing before the start of the decoding, and selects the audio element not to be transferred.

For example, in the assigned position A(2), as indicated by the arrow A22, the EXT element is assigned to the head of the frames of the input bit stream, and is recorded in the server. Here, each rectangle below the EXT element, that is, each rectangle placed on the lower side in the drawing, indicates a single audio element (SCE or CPE) in a manner similar to that of FIG. 1.

In this example, in the input bit stream recorded in the server, the EXT element is further assigned to the head of the structure shown in FIG. 1.

Therefore, in this case, the client (decoder) receives the EXT elements in the input bit stream and reads the priority information, in the time frame as a first target. Then, on the basis of the priority information, the client selects the audio element not to be transferred, and requests (commands) the server not to transfer the audio element.

<Adjustment Process of Transfer Bit Rate>

Subsequently, the transfer bit rate adjustment process for performing decoding with the amended minimum decoder input buffer size will be described.

For example, as described above server, the encoder adjusts the amount of bits of the audio element (encoded data) so as to decode each audio element of the input bit stream, which is assigned to the server, with the amended minimum decoder input buffer size.

Figure 4:
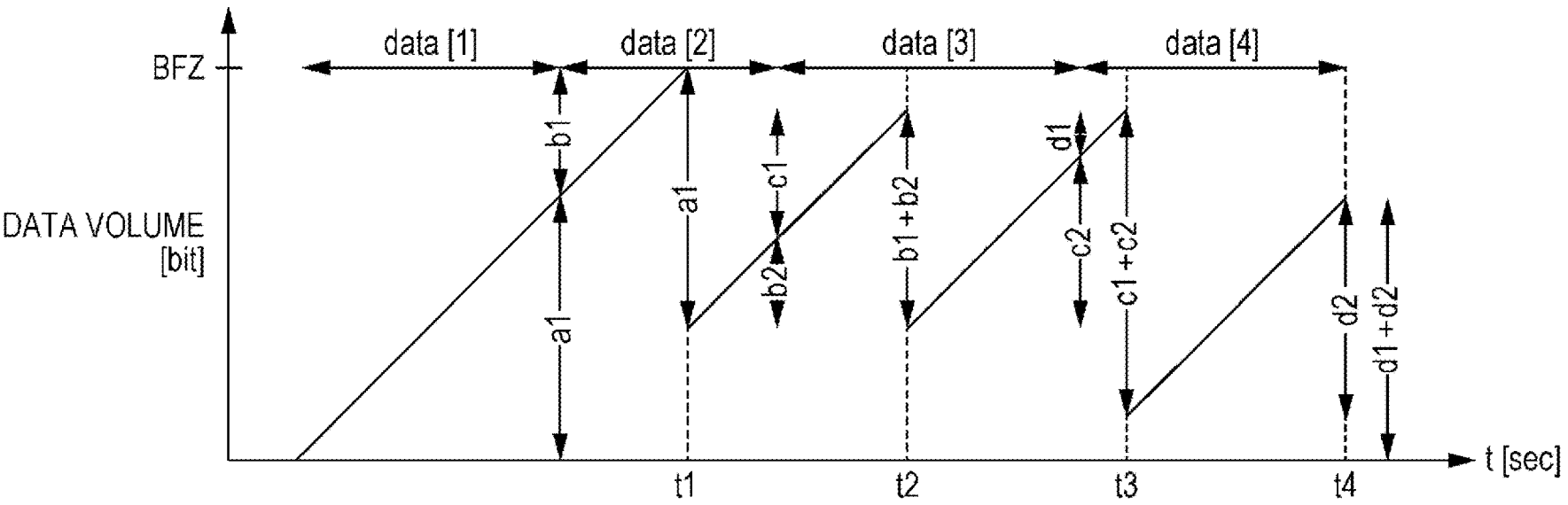
FIG. 4 is a diagram illustrating adjustment of a transfer bit rate.

Consequently, when the audio elements of a certain combination are selected on the decoder side, for example as shown in FIG. 4, even when the input bit streams are sequentially decoded while being stored in the buffer with the necessary buffer size, underflow and overflow do not occur.

In FIG. 4, the vertical axis indicates the data amount of the input bit stream which is stored in the buffer on the decoder side at each time, and the horizontal axis indicates the time period. Further, in the drawing, the slope of the diagonal line indicates the transfer bit rate of the input bit stream, and it is assumed that the transfer bit rate is, for example, an average bit rate of the transfer channel of the input bit stream or the like.

In this example, data[1] to data[4] indicate the time periods in which the audio elements corresponding to each time frame are received from the server and are stored in the buffer. a1, b1, b2, c1, c2, d1, and d2 respectively indicate the amounts of data pieces which are stored in the buffer in a predetermined time period. Further, BFZ in the vertical axis indicates the minimum decoder input buffer size.

In FIG. 4, when the received audio elements are stored in the buffer of the decoder by an amount of BFZ, decoding of the audio elements of the first time frame is started, and thereafter decoding of the audio elements of each time frame is performed at a fixed time interval.

For example, at the time t1, data of the first time frame having a data amount of a1, that is, the audio elements of the first time frame, are read from the buffer and are decoded. Likewise, respectively at the times t2 to t4, the audio elements of the second to fourth time frames are read from the buffer and are decoded.

At this time, the data amount of the audio elements stored in the buffer is equal to or greater than 0 even at any time, and is equal to or less than BFZ. Thus, neither underflow nor overflow occurs. Consequently, the contents are reproduced without interruption continuously in time.

However, even if any combination of the audio elements is selected, encoding, which is performed while adjusting the amount of bits of the encoded data, is performed under a premise that all the audio elements constituting the selected combination are decoded. That is, there is no consideration for a case where some of all the audio elements constituting the combination selected on the basis of the priority information or the like are not decoded.

Hence, if the audio elements of some objects among the audio elements of the combination as a decoding target are not decoded, the amount of bits for each time frame on the encoder side is not adjusted, and is not matched with the amount of bits consumed by decoding in each time frame on the decoder side. Then, in some cases, overflow or underflow occurs on the decoder side, and it is difficult to perform decoding at the above-mentioned amended minimum decoder input buffer size.

Therefore, in the embodiment of the present technology, the amount of bits on the encoder side is adjusted, and is matched with the amount of bits consumed on the decoder side. In order to perform decoding at the above-mentioned amended minimum decoder input buffer size, the following transfer bit rate adjustment process RMT(1) or RMT(2) is performed.

<Transfer Bit Rate Adjustment Process RMT(1)>

The size of the audio element of the object, which is not included in the transfer data for each time frame, is read, a time period, in which the transfer is stopped, is calculated from the size, and the transfer is stopped only in the time period.

<Transfer Bit Rate Adjustment Process RMT(2)>

The size of the audio element of the object, which is not included in the transfer data for each time frame, is read, and the transfer rate of the time frame as a transfer target is adjusted on the basis of the size.

Figure 5:
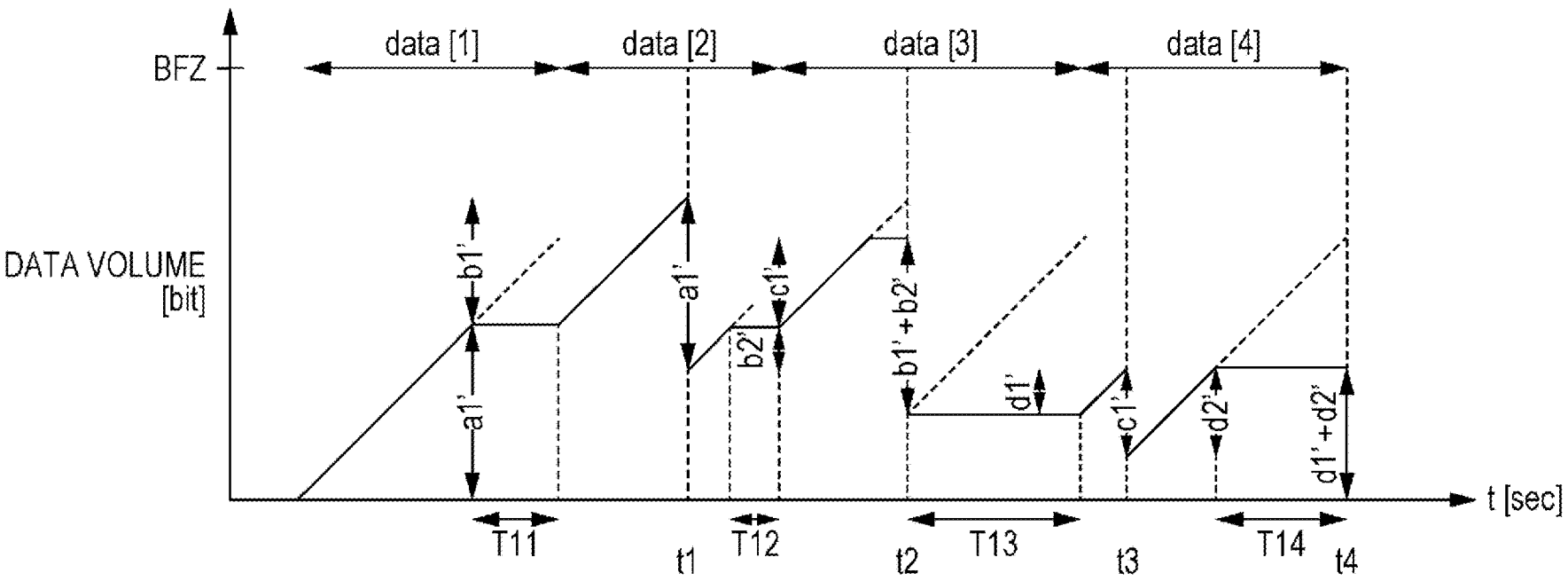
FIG. 5 is a diagram illustrating adjustment of the transfer bit rate.

In the transfer bit rate adjustment process RMT(1), for example as shown in FIG. 5, transfer of the input bit stream is stopped only in a predetermined time period, thereby actually changing the transfer bit rate.

In FIG. 5, the vertical axis indicates the data amount of the input bit stream which is stored in the buffer on the decoder side at each time, and the horizontal axis indicates the time period. Further, in FIG. 5, portions corresponding to those in the case of FIG. 4 are represented by the same reference signs and numerals, and the description thereof will be appropriately omitted.

In this example, the data amounts indicated by a1, b1, b2, c1, d1, and d2 in FIG. 4 are respectively represented by a1', b1', b2', c1', d1', and d2'.

For example, the total data amount of the audio elements of the decoding target in the first time frame is a1 in FIG. 4, but the total data amount is a1' in FIG. 5 since decoding of the audio elements of predetermined objects is not performed.

Hence, only in the time period T11, transfer of the input bit stream is stopped. The time period T11 depends on: the size (data amount) of the audio element of the object, which is not decoded in the first frame, that is, which is selected on the basis of the priority information and the like; and the transfer bit rate of the input bit stream, that is, the slope of the diagonal line in the drawing.

Likewise, also in the time frames subsequent to the first time frame, in each of the time periods T12 to T14, transfer of the input bit stream is stopped.

The transfer bit rate control may be performed on the server side, and may be performed by performing buffer control on the decoder side.

When the bit rate control is performed on the server side, for example, the decoder may instruct the server to temporarily stop transfer of the input bit stream, and the server may calculate a transfer stop time period so as to temporarily stop transfer of the input bit stream.

When the transfer bit rate control is performed through the buffer control on the decoder side, for example, the decoder temporarily stops transfer (storage) of the audio elements at the time of transferring the audio elements to an audio buffer for decoding, from a system buffer in which the received input bit stream is stored.

Here, the system buffer is regarded as, for example, a buffer in which not only the input bit stream of a voice constituting contents but also the input bit stream of a video constituting contents and the like are stored. Further, the audio buffer is a decoding buffer for which it is necessary to ensure the buffer size equal to or greater than the minimum decoder input buffer size.

Figure 6:
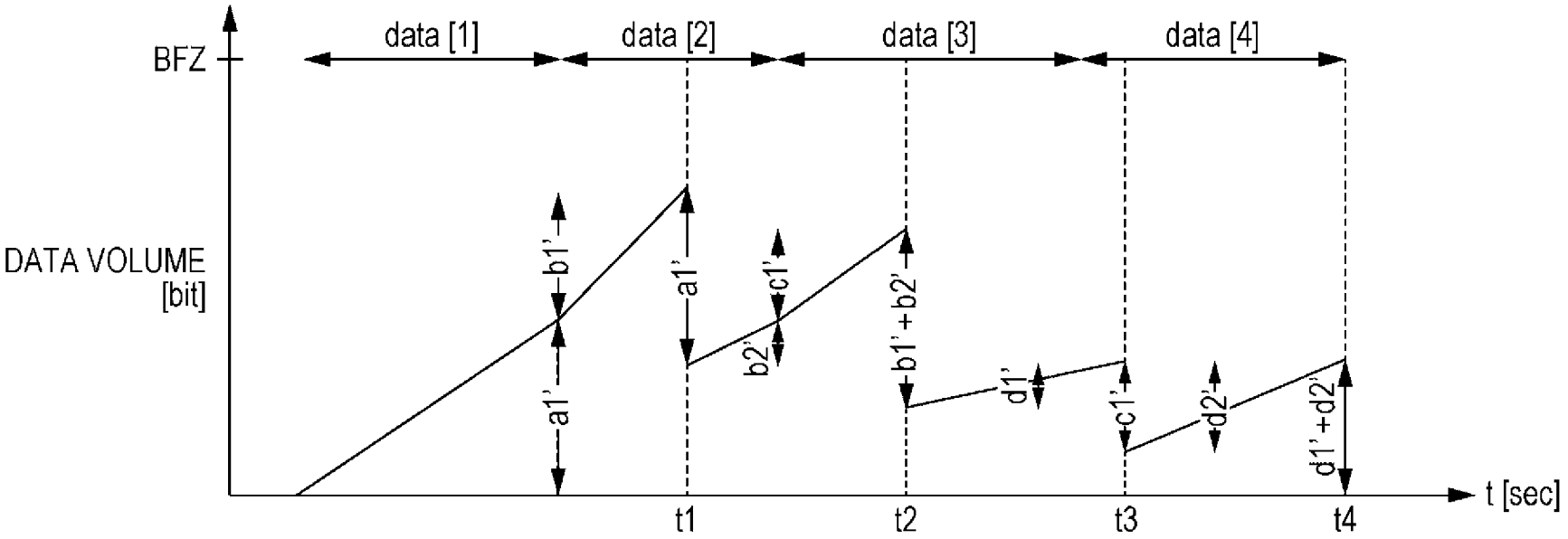
FIG. 6 is a diagram illustrating adjustment of the transfer bit rate.

In contrast, in the transfer bit rate adjustment process RMT(2), for example as shown in FIG. 6, the transfer bit rate of the input bit stream is set to be variable.

In FIG. 6, the vertical axis indicates the data amount of the input bit stream which is stored in the audio buffer on the decoder side at each time, and the horizontal axis indicates the time period. Further, in FIG. 6, portions corresponding to those in the case of FIG. 4 or 5 are represented by the same reference signs and numerals, and the description thereof will be appropriately omitted.

For example, the total data amount of the audio elements of the decoding target in the first time frame is a1 in FIG. 4, but the total data amount is a1' in FIG. 6 since decoding of the audio elements of predetermined objects are not performed.

Hence, after the audio elements corresponding to the first frame are acquired, in the time period to the time t1, transfer of the audio elements is performed at a new transfer bit rate. The new transfer bit rate depends on: the size of the audio element of the object, which is not decoded in the first frame, that is, which is selected on the basis of the priority information and the like; and the transfer bit rate of the input bit stream, that is, the slope of the diagonal line in the drawing.

Likewise, also in the time period subsequent thereto, transfer of the input bit stream is performed at the transfer bit rate which is newly calculated. For example, it is preferable that the new transfer bit rate is determined such that, in the time period from the time t2 to the time t3, the total data amount of the audio elements stored in the audio buffer at the time t3 is equal to that in the case at the time t3 in the example of FIG. 5.

The transfer bit rate control may be performed on the server side, and may be performed by performing buffer control on the decoder side.

When the bit rate control is performed on the server side, for example, the decoder may issue an instruction of the new transfer bit rate of the input bit stream to the server, and the server may calculate the new transfer bit rate.

When the transfer bit rate control is performed through the buffer control on the decoder side, for example, the decoder calculates the new transfer bit rate, and transfers the audio elements from the system buffer to the audio buffer at the new transfer bit rate.

Here, if the transfer bit rate adjustment process RMT(1) or RMT(2) is performed, it is necessary to prefetch the size of the audio element of the object which is not a decoding target. Therefore, in the embodiment of the present technology, size information representing the sizes of the audio elements is assigned in, for example, any one of the following size information layouts SIL(1) to SIL(3). It should be noted that the layout of the size information may be any layout if the layout can be prefetched.

<Size Information Layout SIL(1)>

The size information is provided as a single file, and thus the client reads the sizes of the audio elements corresponding to all frames or several prefectched frames at the start of the decoding.

<Size Information Layout SIL(2)>

The size information is assigned to the head of the frames in the input bit stream, and the client reads the size information for each time frame.

<Size Information Layout SIL(3)>

The size information is defined in the head of the audio elements, and the client reads the size information for each audio element.

Figure 7:
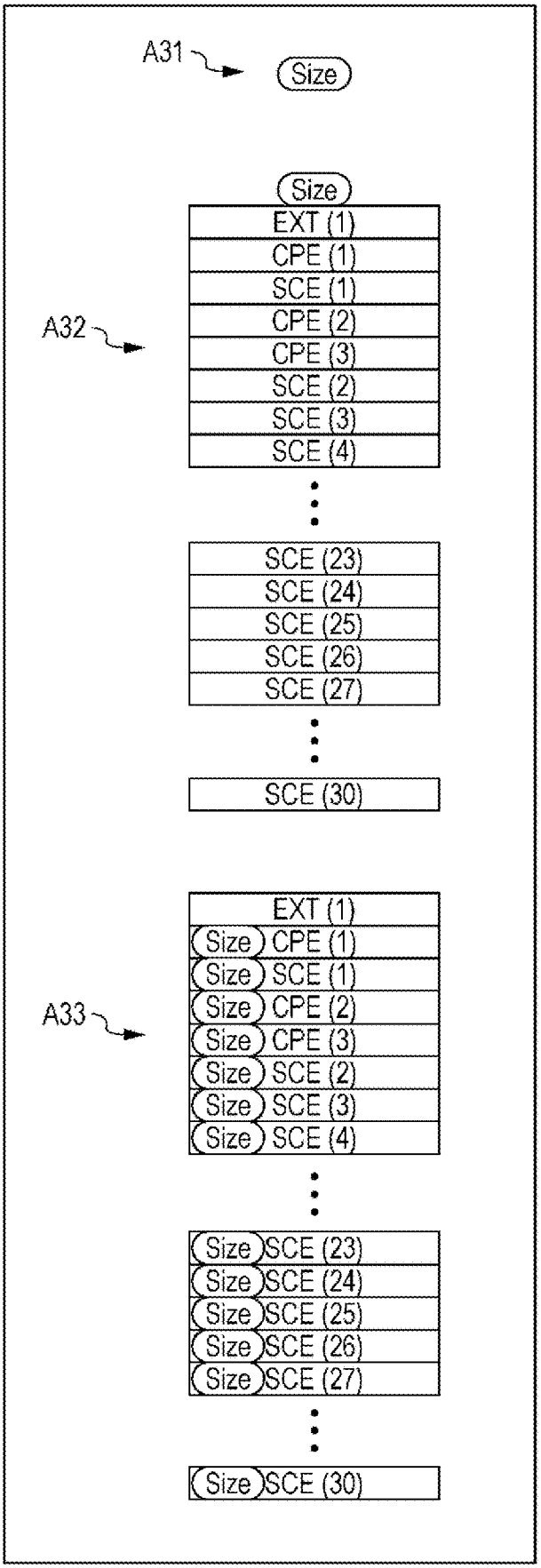
FIG. 7 is a diagram illustrating size information.

In the size information layout SIL(1), for example as indicated by the arrow A31 of FIG. 7, a single file is recorded in the server. In the file, the size information for each time frame of all the audio elements constituting the contents is stored. In addition, in FIG. 7, an ellipse, in which the text "Size" is written, indicates the size information.

In this example, for example, the client (decoder) acquires the size information from the server at arbitrary timing before the start of decoding, and performs the transfer bit rate adjustment process RMT(1) or RMT(2).

For example, in the size information layout SIL(2), as indicated by the arrow A32, the size information is assigned to the head of the frames of the input bit stream, and is recorded in the server. Here, each rectangle placed below the size information indicates a single audio element (SCE or CPE) or EXT element, in a manner similar to that in the case of FIG. 3.

In this example, in the input bit stream recorded in the server, the size information is further assigned to the head of the structure indicated by the arrow A22 of FIG. 3.

Consequently, in this case, for example, the client (decoder) first receives the size information or the EXT element of the input bit stream, selects the audio element not to be transferred, and performs the transfer bit rate adjustment process RMT(1) or RMT(2) in accordance with the selection.

For example, in the size information layout SIL(3), as indicated by the arrow A33, the size information is assigned to the head portion of the audio elements. Consequently, in this case, for example, the client (decoder) reads the size information from the audio elements, and performs the transfer bit rate adjustment process RMT(1) or RMT(2).

In the example of the above description, the audio element of the object is not transferred, but the present technology is not limited to the object. Even when any audio element constituting the combinations is not transferred, decoding at the minimum decoder input buffer size can be performed in a manner similar to that in the example of the above-mentioned object.

As described above, the unnecessary audio elements, which are not decoding targets, in the input bit stream are selected on the meta data and the like so as not be transferred, whereby it is possible to reduce the transfer bit rate.

When an arbitrary audio element constituting the input bit stream is not set as a decoding target, by appropriately adjusting the transfer bit rate, decoding at the minimum decoder input buffer size can be performed.

<Configuration Example of Contents Transfer System>

Next, a specific embodiment, to which the present technology mentioned above is applied, will be described.

Hereinafter, a description will be given of an exemplary case in which the embodiment of the present technology is applied to the contents transfer system prescribed by MPEG-DASH. In such a case, the contents transfer system, to which the embodiment of the present technology is applied, is configured, for example as shown in FIG. 8.

Figure 8:
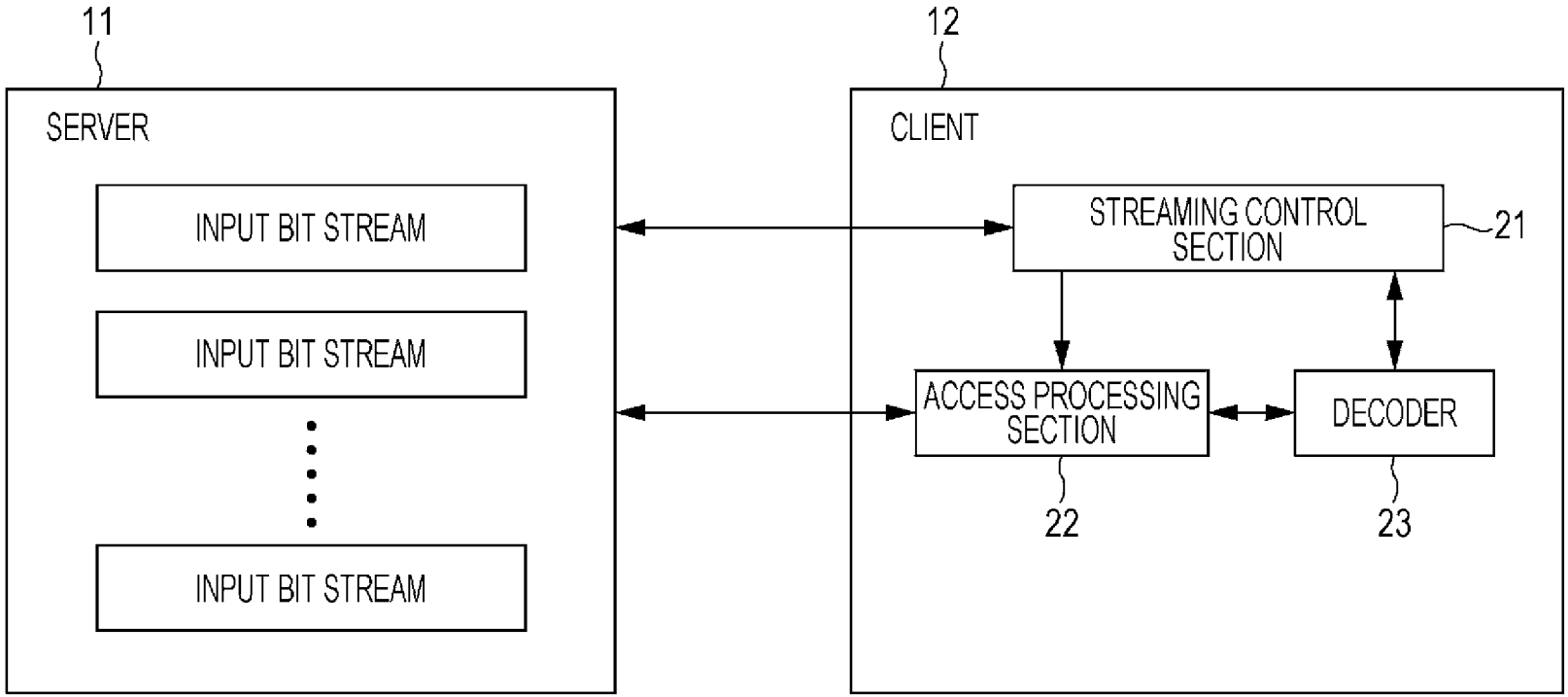
FIG. 8 is a diagram illustrating a configuration example of a contents transfer system.

The contents transfer system shown in FIG. 8 includes the server 11 and the client 12, and the server 11 and the client 12 are connected to each other through wired or wireless communication network such as the Internet.

In the server 11, for example, for each of a plurality of transfer bit rates, the bit streams are recorded. The bit stream can be obtained by dividing the input bit stream shown in FIG. 1 or the input bit stream shown in FIG. 2 for each of the combinations of the audio elements.

Further, in the server 11, the EXT element described with reference to FIG. 3 is recorded. The EXT element is assigned as a single file to the head portion of the frames of the input bit streams or the divided input bit streams. Furthermore, in the server 11, the size information described with reference to FIG. 7 is recorded. The size information is assigned as a single file to the head portion of the frames of the input bit streams or the divided input bit streams or the head portion of the audio elements.

The server 11 transmits the input bit stream, the EXT element, the size information, or the like to the client 12, in response to the request issued from the client 12.

Further, the client 12 receives the input bit stream from the server 11, and decodes and reproduces the input bit stream, thereby streaming reproduction of the contents.

It should be noted that, regarding of reception of the input bit stream, the entire input bit stream may be received, and only a divided part of the input bit stream may be received. Hereinafter, when it is not necessary to particularly distinguish the entirety and a part of the input bit stream, those are simply referred to as the input bit stream.

The client 12 has a streaming control section 21, an access processing section 22, and a decoder 23.

The streaming control section 21 controls the entire operation of the client 12. For example, the streaming control section 21 receives the EXT element, the size information, the other control information from the server 11, and controls streaming reproduction on the basis of the information which is supplied to or received from the access processing section 22 or the decoder 23 as necessary.

In response to the request of the decoder 23 or the like, the access processing section 22 requests the server 11 to transmit the input bit stream of the audio elements of the predetermined combination at the predetermined transfer bit rate, receives the input bit stream transmitted from the server 11, and supplies the input bit stream to the decoder 23. The decoder 23 decodes the input bit stream, which is supplied from the access processing section 22, while interchanging the information with the streaming control section 21 or the access processing section 22 as necessary, and gives an output to a speaker, which is not shown in the drawing, or the like.

<Configuration Example of Decoder 1>

Subsequently, a more specific configuration than that of the decoder 23 shown in FIG. 8 will be described. For example, the decoder 23 is configured more specifically, as shown in FIG. 9.

Figure 9:
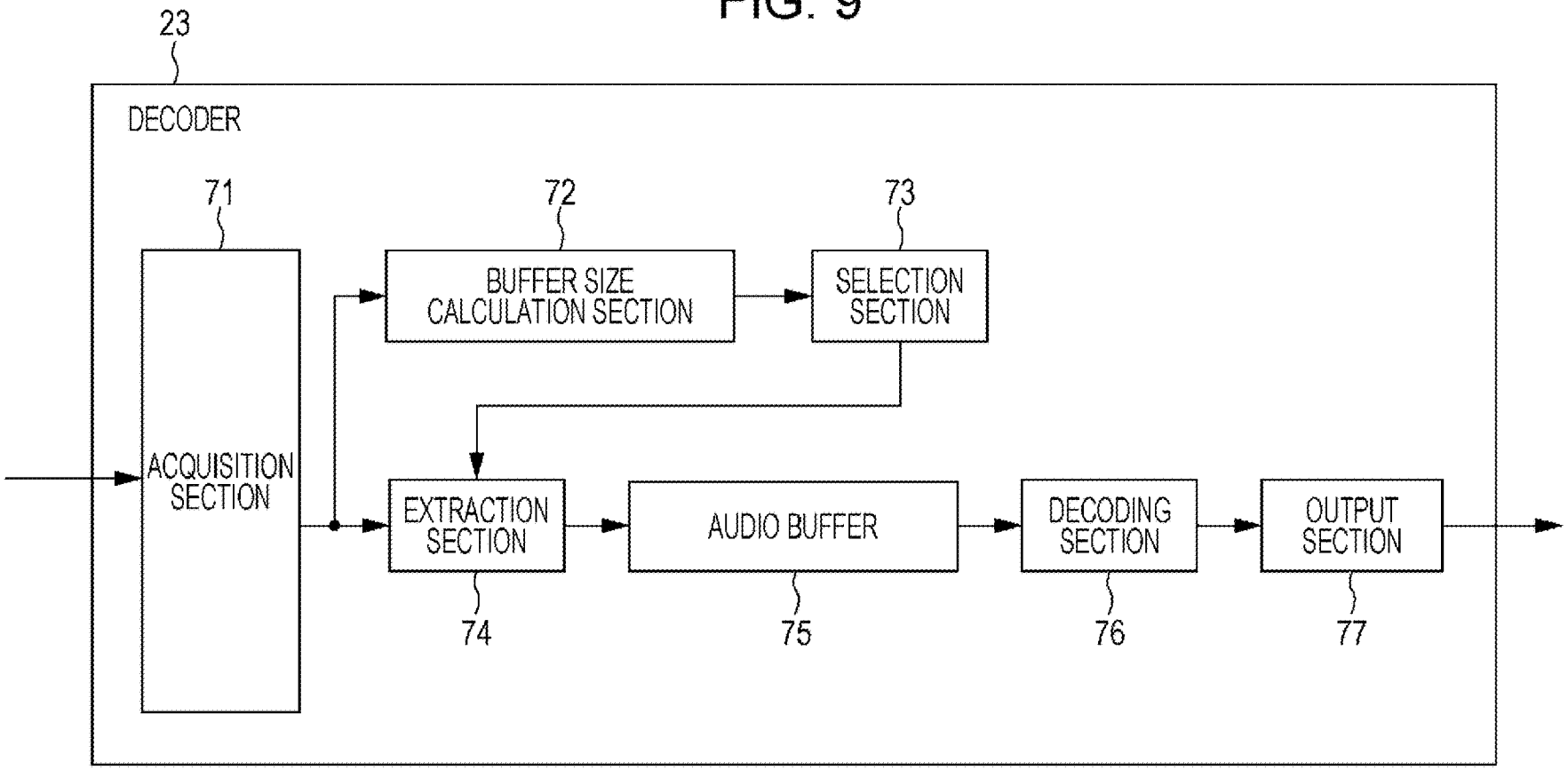
FIG. 9 is a diagram illustrating a configuration example of a decoder.

The decoder 23 shown in FIG. 9 has an acquisition section 71, a buffer size calculation section 72, a selection section 73, an extraction section 74, an audio buffer 75, a decoding section 76, and an output section 77.

In this example, for example, the input bit stream with the predetermined transfer bit rate of the configuration shown in FIG. 1 is supplied from the access processing section 22 to the acquisition section 71. In addition, the access processing section 22 is able to select, for each time frame, which transfer bit rate to receive the input bit stream from the server 11, for example, on the basis of a situation of the communication network of the access processing section 22 and the like. That is, it is possible to change the transfer bit rate for each time frame.

The acquisition section 71 acquires the input bit stream from the access processing section 22, and supplies the input bit stream to the buffer size calculation section 72 and the extraction section 74. The buffer size calculation section 72 calculates the necessary buffer size for each of the combinations of the audio elements on the basis of the input bit stream supplied from the acquisition section 71, and supplies the necessary buffer size to the selection section 73.

The selection section 73 compares the allowable memory size of the decoder 23, that is, the audio buffer 75, with the necessary buffer size of each of the combinations of the audio elements supplied from the buffer size calculation section 72, selects a combination of the audio elements as a decoding target, and supplies the selection result to the extraction section 74.

The extraction section 74 extracts the audio elements of the selected combination from the input bit stream supplied from the acquisition section 71, on the basis of the selection result supplied from the selection section 73, and supplies the audio elements to the audio buffer 75.

The audio buffer 75 is a buffer with the predetermined allowable memory size which is determined in advance. The audio buffer 75 temporarily holds the audio elements as a decoding target supplied from the extraction section 74, and supplies the audio elements to the decoding section 76. The decoding section 76 reads the audio elements from the audio buffer 75 on a time frame basis, and performs decoding. In addition, the decoding section 76 generates an audio signal having a predetermined channel configuration on the basis of the audio signal obtained by the decoding, and supplies the audio signal to the output section 77. The output section 77 outputs the audio signal, which is supplied from the decoding section 76, to a rear side speaker and the like.

<Description of Decoding Process 1>

Subsequently, a decoding process performed by the decoder 23 shown in FIG. 9 will be described. For example, the decoding process is performed for each time frame.

In step S11, the acquisition section 71 acquires the input bit stream from the access processing section 22, and supplies the input bit stream to the buffer size calculation section 72 and the extraction section 74.

In step S12, the buffer size calculation section 72 calculates the necessary buffer size for each of the combinations of the audio elements on the basis of the input bit stream supplied from the acquisition section 71, and supplies the necessary buffer size to the selection section 73.

Specifically, the buffer size calculation section 72 sets the sum between twice the number of CPEs and the number of SCEs, which constitute the combination of the audio elements as a calculation target, as NCC, and calculates a product of NCC and 6144, as the necessary buffer size (minimum decoder input buffer size).

The selectable combination of the audio elements, which are stored in the input bit stream, can be specified by referring to the meta data or the like. Further, when the information representing the necessary buffer sizes for combinations is stored in the input bit stream, the buffer size calculation section 72 reads the information representing the necessary buffer sizes from the input bit stream, and supplies the information to the selection section 73.

In step S13, the selection section 73 selects the combination of the audio elements on the basis of the necessary buffer sizes supplied from the buffer size calculation section 72, and supplies the selection result to the extraction section 74.

That is, the selection section 73 compares the allowable memory size of the decoder 23, that is, the audio buffer 75, with the necessary buffer size of each of the combinations of the audio elements, and selects one combination, which satisfies the buffer size condition, as a decoding target. Then, the selection section 73 supplies the selection result to the extraction section 74.

In step S14, the extraction section 74 extracts the audio elements of the combination, which is indicated by the selection result supplied from the selection section 73, from the input bit stream supplied from the acquisition section 71, and supplies the audio elements to the audio buffer 75.

In step S15, the decoding section 76 reads the audio elements corresponding to a single time frame from the audio buffer 75, and decodes the audio elements, that is, the encoded data in which the audio elements are stored.

The decoding section 76 generates the audio signal having the predetermined channel configuration on the basis of the audio signal obtained by decoding, and supplies the audio signal to the output section 77. For example, the decoding section 76 allocates the audio signal of the objects into each channel corresponding to the speaker, and generates the audio signal for each channel having a desired channel configuration.

In step S16, the output section 77 outputs the audio signal supplied from the decoding section 76 to the rear side speaker and the like, and ends the decoding process.

As described above, the decoder 23 selects the combination of the audio elements on the basis of the self-allowable memory sizes and the necessary buffer sizes, and performs decoding. Thereby, it is possible to decode the input bit stream in various apparatuses having different hardware scales.

Second Embodiment

<Configuration Example of Decoder 2>

Figure 11:
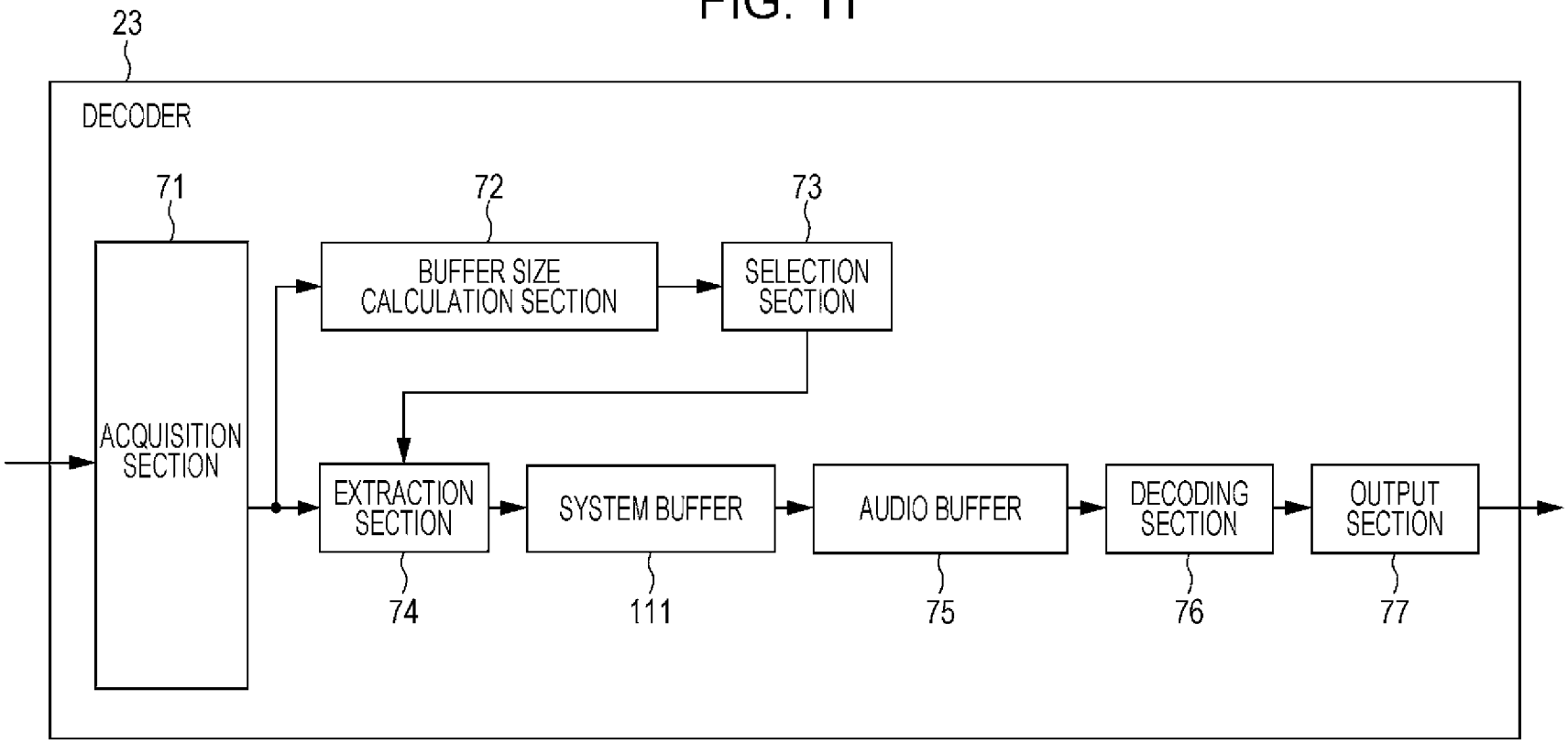
FIG. 11 is a diagram illustrating a configuration example of a decoder.

In the description of the example of the decoder 23 shown in FIG. 9, the combination of the audio elements is selected. However, in the decoder 23, on the basis of the meta data such as priority information, the unnecessary audio elements, which are not the decoding target, may be selected. In such a case, the decoder 23 is configured, for example, as shown in FIG. 11. In addition, in FIG. 11, portions corresponding to those in the case of FIG. 9 are represented by the same reference signs and numerals, and the description thereof will be appropriately omitted.

The decoder 23 shown in FIG. 11 has the acquisition section 71, the buffer size calculation section 72, the selection section 73, the extraction section 74, a system buffer 111, the audio buffer 75, the decoding section 76, and the output section 77. The configuration of the decoder 23 shown in FIG. 11 is different from that of the decoder 23 of FIG. 9 in that the system buffer 111 is newly provided. Otherwise, the configuration of the decoder 23 shown in FIG. 11 is the same as that of the decoder 23 of FIG. 9.

In the decoder 23 shown in FIG. 11, for example, the input bit stream of the predetermined transfer bit rate having the configuration shown in FIG. 1 is supplied.

The acquisition section 71 acquires the EXT element and the size information from the server 11, supplies the EXT element to the selection section 73 through the buffer size calculation section 72, and supplies the size information to the system buffer 111 through the extraction section 74.

For example, as indicated by the arrow A21 of FIG. 3, if the EXT element is recorded in the server 11 alone, the acquisition section 71 acquires the EXT element from the server 11 through the streaming control section 21 at arbitrary timing before the start of decoding.

Further, for example, as indicated by the arrow A22 of FIG. 3, if the EXT element is assigned to the frame head of the input bit stream, the acquisition section 71 supplies the input bit stream to the buffer size calculation section 72. Then, the buffer size calculation section 72 reads the EXT element from the input bit stream, and supplies the EXT element to the selection section 73.

Hereinafter, the description will be continued under the following assumption: as indicated by the arrow A21 of FIG. 3, the EXT element is recorded in the server 11 alone, and the EXT element is supplied to the selection section 73 in advance.

For example, as indicated by the arrow A31 of FIG. 7, if the size information is recorded in the server 11 alone, the acquisition section 71 acquires the size information from the server 11 through the streaming control section 21 at arbitrary timing before the start of decoding.

Further, for example, as indicated by the arrow A32 or the arrow A33 of FIG. 7, if the size information is assigned to the head of the frames or is assigned to the head of the audio elements, the acquisition section 71 supplies the input bit stream to the extraction section 74. Then, the extraction section 74 reads the size information from the input bit stream, and supplies the information to the system buffer 111.

Hereinafter, the description will be continued under the following assumption: as indicated by the arrow A31 of FIG. 7, the size information is recorded in the server 11 alone, and the size information is supplied to the system buffer 111 in advance.

The selection section 73 selects the combination of the audio elements, on the basis of the necessary buffer sizes supplied from the buffer size calculation section 72. Further, the selection section 73 selects the unnecessary audio element which is not the decoding target, that is, the audio element not to be transferred, from the audio elements constituting the selected combination, on the basis of the priority information. The priority information is included in the EXT element supplied from the buffer size calculation section 72.

It should be noted that the unnecessary audio elements may be the audio element of the object, and may be an audio element other than that.

The selection section 73 supplies the selection result of the combination and the selection result of the unnecessary audio element to the extraction section 74.

The extraction section 74 forms the selected combination from the input bit stream supplied from the acquisition section 71 on the basis of the selection result supplied from the selection section 73, extracts the audio elements other than the unnecessary audio element, and supplies the audio elements to the system buffer 111.

The system buffer 111 performs the buffer control through the above-mentioned transfer bit rate adjustment process RMT(1) or RMT(2), on the basis of the size information which is supplied from the extraction section 74 in advance, and supplies the audio elements, which are supplied from the extraction section 74, to the audio buffer 75. It should be noted that, hereinafter assuming that the transfer bit rate adjustment process RMT(1) is performed, the description will be continued.

<Description of Decoding Process 2>

Figure 12:
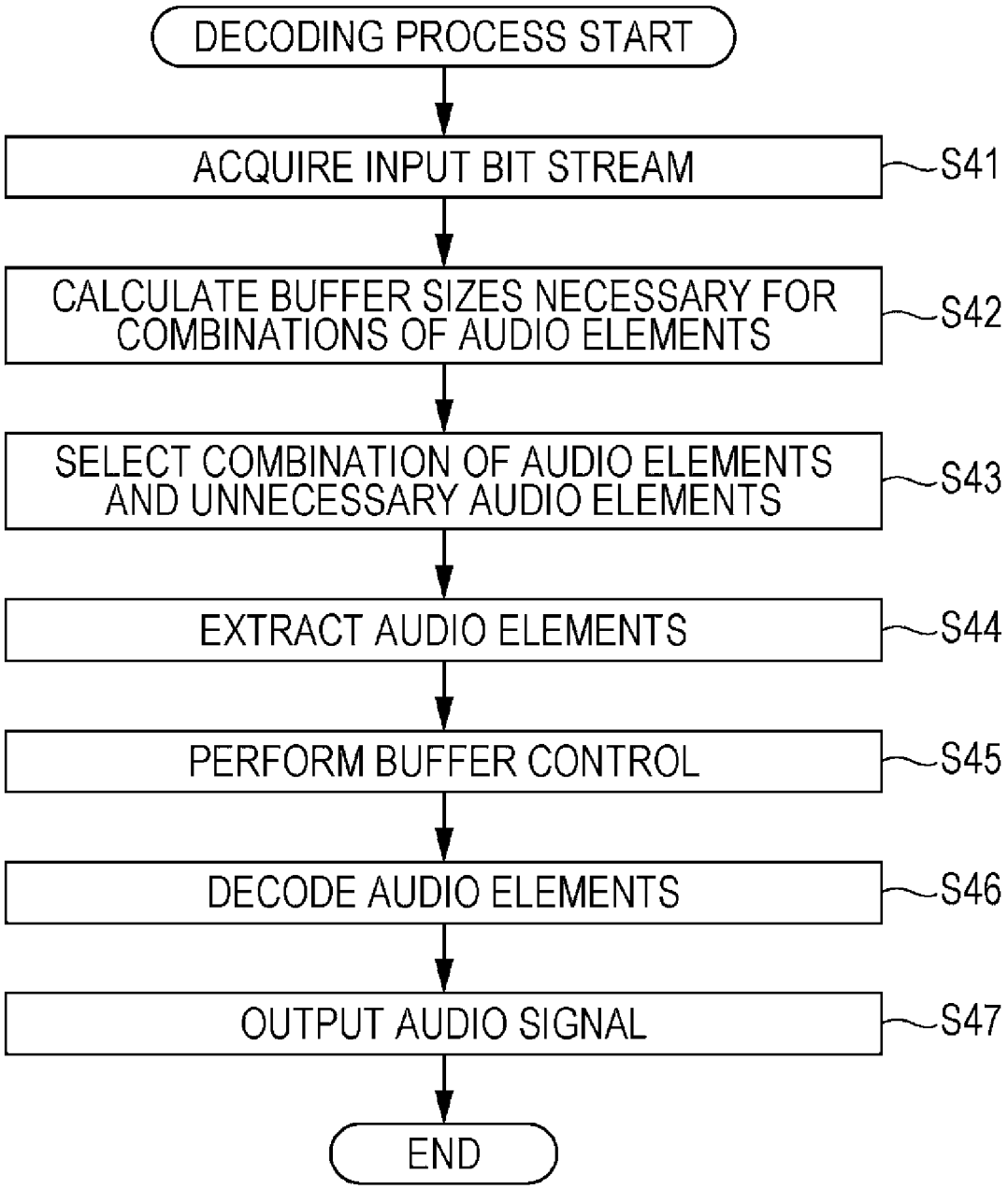
FIG. 12 is a flowchart illustrating a decoding process.

Next, referring to the flowchart of FIG. 12, the decoding process performed by the decoder 23 shown in FIG. 11 will be described. It should be noted that the processes of steps S41 and S42 are the same as the processes of steps S11 and S12 of FIG. 10, and the description thereof will be omitted.

In step S43, the selection section 73 selects the unnecessary audio element and the combination of the audio elements, on the basis of the priority information included in the EXT element and the necessary buffer sizes supplied from the buffer size calculation section 72.

Figure 10:
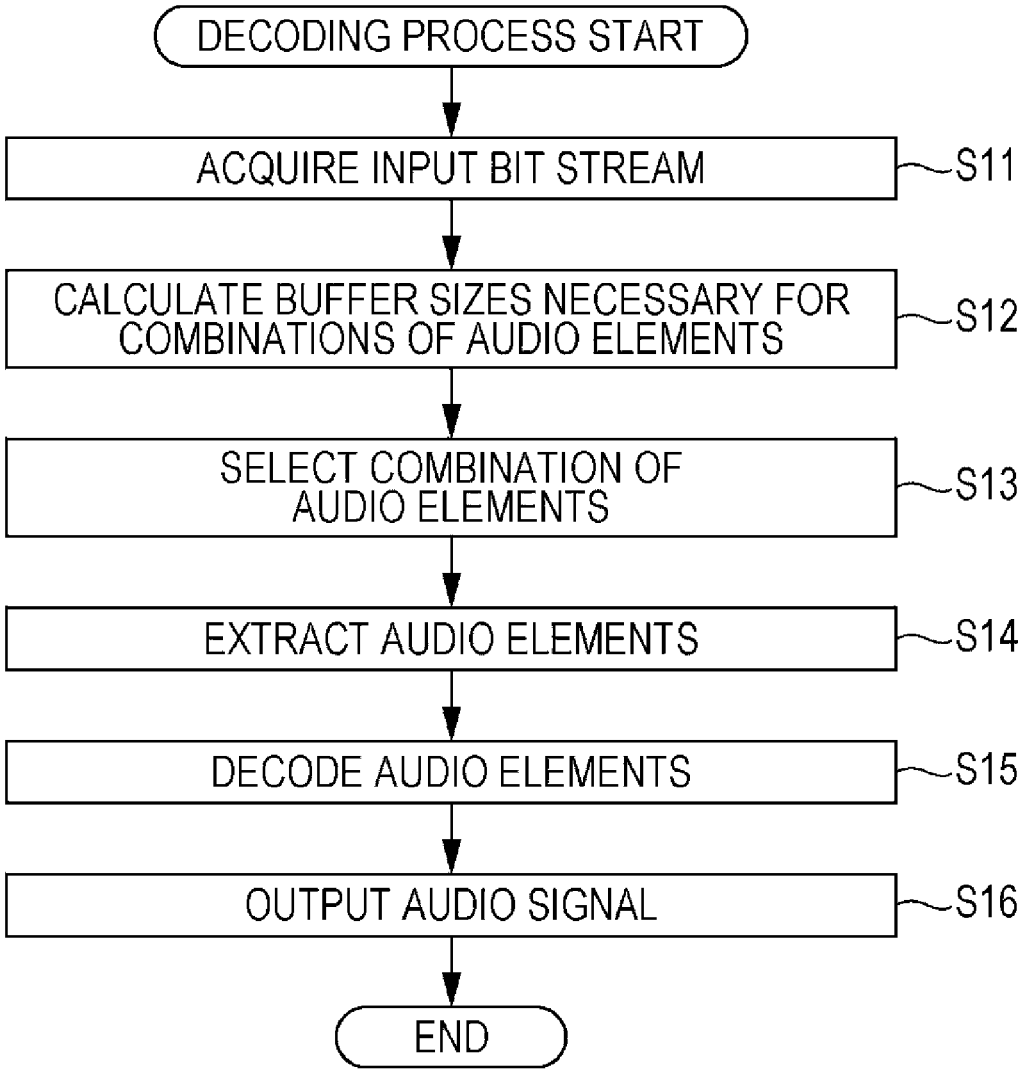
FIG. 10 is a flowchart illustrating a decoding process.

For example, the selection section 73 performs the same process as that of step S13 of FIG. 10, and selects the combination of the audio elements. Further, the selection section 73 selects the audio element, of which a value of the priority information is equal to or less than the predetermined threshold value, as the unnecessary audio element, which is not the decoding target, among the audio elements of the selected combination.

The selection section 73 supplies the selection result of the combination and the selection result of the unnecessary audio element to the extraction section 74.

In step S44, the extraction section 74 forms the selected combination from the input bit stream supplied from the acquisition section 71 on the basis of the selection result supplied from the selection section 73, extracts the audio elements other than the unnecessary audio element, and supplies the audio elements to the system buffer 111. Further, the extraction section 74 supplies the information representing the unnecessary audio element, which is selected by the selection section 73 and is not the decoding target, to the system buffer 111.

In step S45, the system buffer 111 performs the buffer control, on the basis of the information representing the unnecessary audio element, which is supplied from the extraction section 74, and the size information which is supplied from the extraction section 74 in advance.

Specifically, the system buffer 111 calculates the time period in which transfer is stopped, on the basis of the size information of the audio elements which are indicated by the information supplied from the extraction section 74. Then, the system buffer 111 transfers the audio elements, which are supplied from the extraction section 74, to the audio buffer 75 while stopping transfer (storage) of the audio elements into the audio buffer 75 only in the calculated time period, at appropriate timing.

When the buffer control is performed, thereafter, the processes of steps S46 and S47 and the decoding process ends. These processes are the same as the processes of steps S15 and S16 of FIG. 10, and thus the description thereof will be omitted.

As described above, the decoder 23 selects the combination of the audio elements, and selects the audio element, which is not a decoding target, on the basis of the priority information. Thereby, it is possible to decode the input bit stream in various apparatuses having different hardware scales. Further, by performing practical transfer bit rate control through the buffer control, decoding at the minimum decoder input buffer size can be performed.

Third Embodiment

<Configuration Example of Decoder 3>

Figure 13:
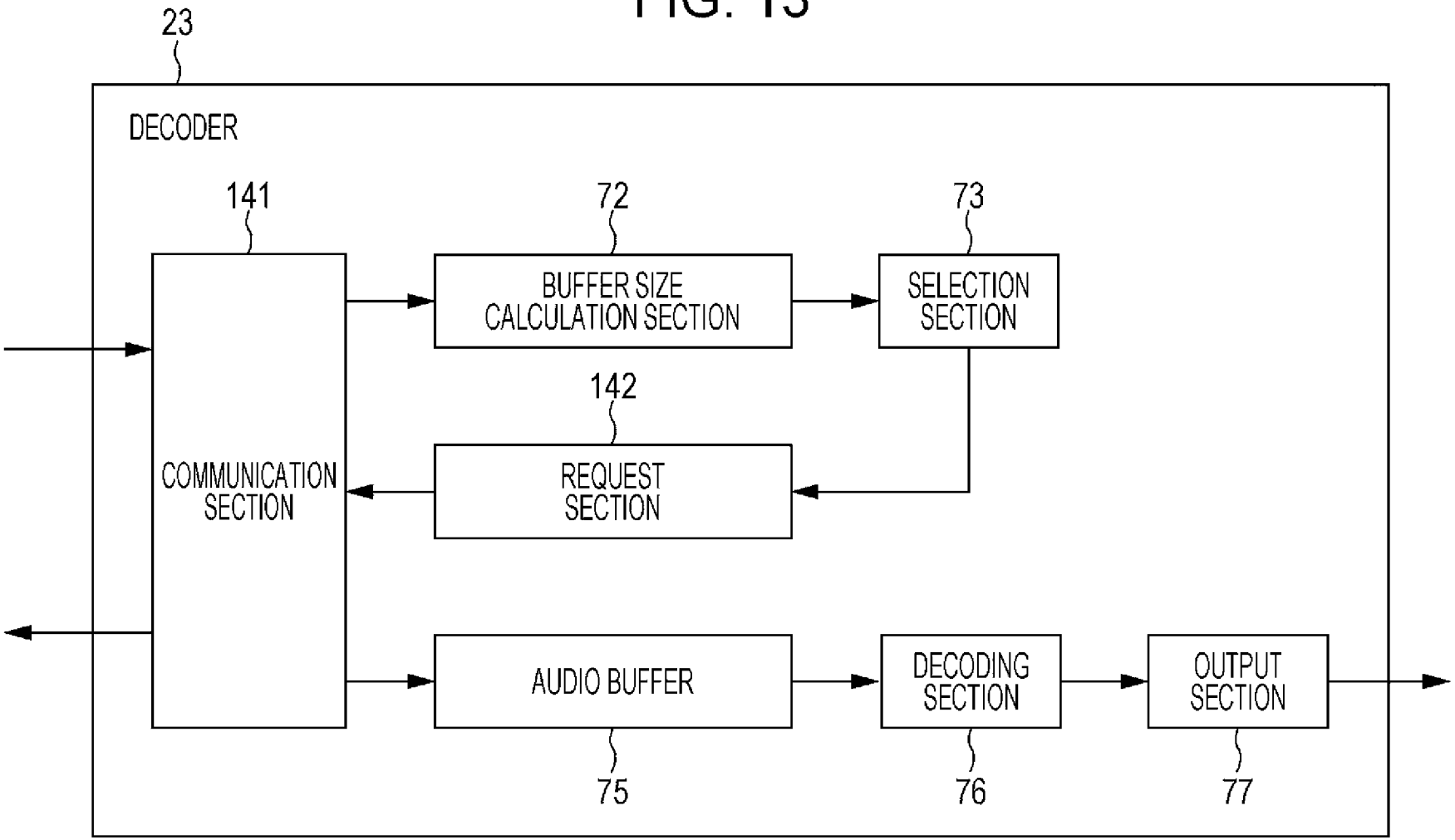
FIG. 13 is a diagram illustrating a configuration example of a decoder.

In the above description of the example, the audio elements of the combination as a decoding target are extracted from the acquired input bit stream. However, the audio elements of the selected combination may be acquired from the server 11. In such a case, the decoder 23 is configured, for example, as shown in FIG. 13. It should be noted that, in FIG. 13, portions corresponding to those in the case of FIG. 9 are represented by the same reference signs and numerals, and the description thereof will be omitted.

The decoder 23 shown in FIG. 13 has a communication section 141, the buffer size calculation section 72, the selection section 73, a request section 142, the audio buffer 75, the decoding section 76, and the output section 77.

The configuration of the decoder 23 shown in FIG. 13 is different from that of the decoder 23 of FIG. 9 in that the acquisition section 71 and the extraction section 74 are not provided and the communication section 141 and the request section 142 are newly provided.

The communication section 141 performs communication with the server 11 through the streaming control section 21 or the access processing section 22. For example, the communication section 141 receives the information representing the combinations of the audio elements that can be acquired from the server 11, and supplies the information to the buffer size calculation section 72, or transmits a transmission request to the server 11. The transmission request is a request to transmit a part of each divided input bit stream which is supplied from the request section 142. Further, the communication section 141 receives a part of each divided input bit stream, which is transmitted from the server 11 in response to the transmission request, and supplies the part of each divided input bit stream to the audio buffer 75.

Here, the information representing the combinations of the audio elements, which can be acquired from the server 11, is stored, for example, as the meta data of the input bit stream, in the input bit stream. In this state, the information is recorded as a single file in the server 11. In addition, here, the information representing the combinations of the audio elements, which can be acquired from the server 11, is recorded as a single file in the server 11.

The request section 142 supplies the transmission request to the communication section 141 on the basis of the selection result of the combination of the audio elements as a decoding target supplied from the selection section 73. The transmission request is a request to transmit a part of the bit stream formed of the audio elements of the selected combination, that is, a part of each divided input bit stream.

<Description of Decoding Process 3>

Figure 14:
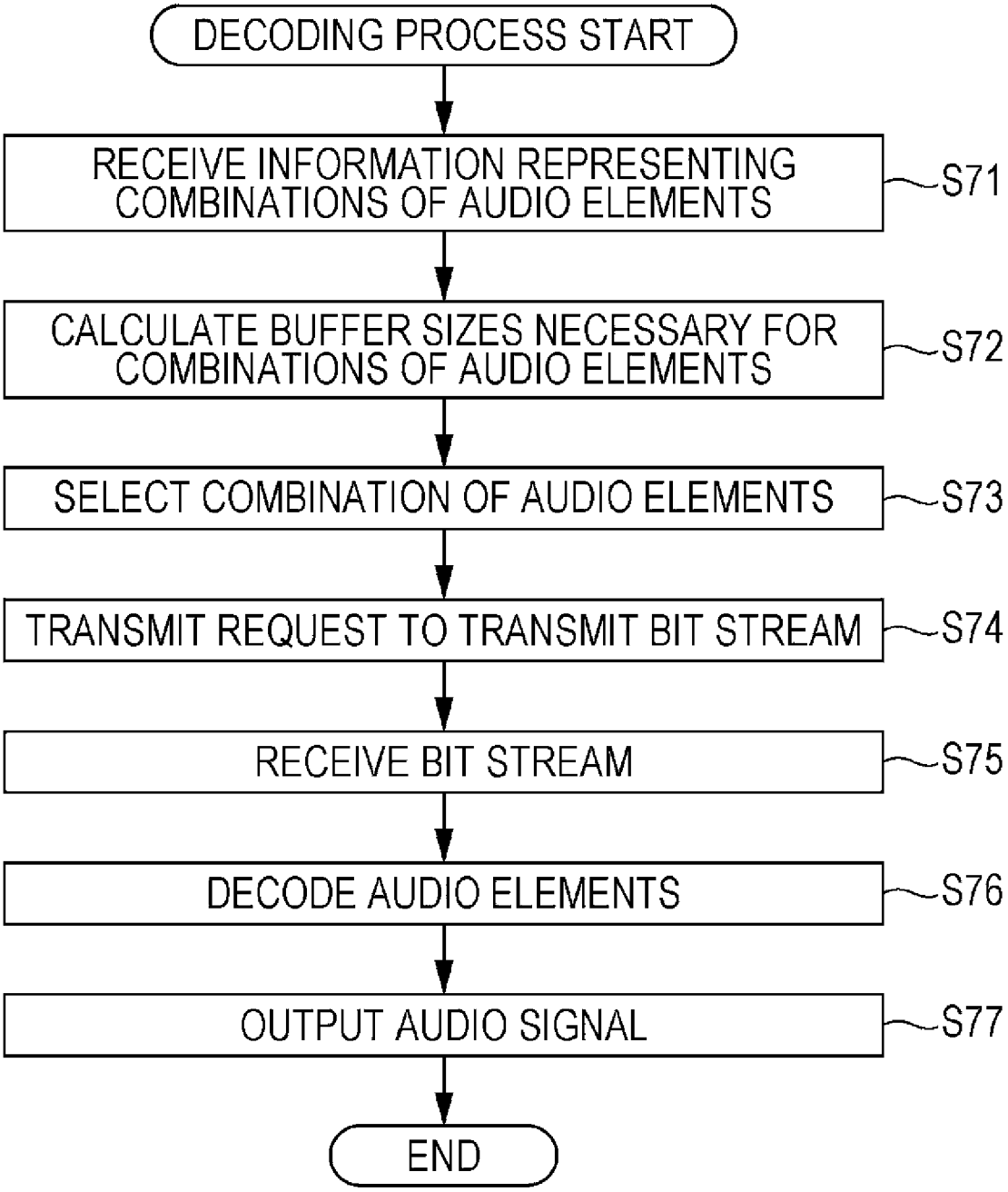
FIG. 14 is a flowchart illustrating a decoding process.

Next, referring to the flowchart of FIG. 14, the decoding process performed by the decoder 23 shown in FIG. 13 will be described.

In step S71, the communication section 141 receives the information representing the combinations of the audio elements which can be acquired from the server 11, and supplies the information to the buffer size calculation section 72.

That is, the communication section 141 transmits the transmission request to transmit the information representing the combinations of the audio elements which can be acquired, to the server 11 through the streaming control section 21. Further, the communication section 141 receives the information, which represents the combinations of the audio elements transmitted from the server 11, through the streaming control section 21, in response to the transmission request, and supplies the information to the buffer size calculation section 72.

In step S72, the buffer size calculation section 72 calculates the necessary buffer size for each of the combinations of the audio elements represented by the information, on the basis of the information that is supplied from the communication section 141 and represents the combinations of the audio elements which can be acquired from the server 11, and supplies the necessary buffer sizes to the selection section 73. In step S72, the same process as that of step S12 in FIG. 10 is performed.

In step S73, the selection section 73 selects the combination of the audio elements on the basis of the necessary buffer sizes supplied from the buffer size calculation section 72, and supplies the selection result to the request section 142. In step S73, the same process as that of step S13 in FIG. 10 is performed. At this time, the selection section 73 may select the transfer bit rate.

When the combination of the audio elements is selected, the request section 142 supplies the transmission request to the communication section 141. The transmission request is a request to transmit the bit stream formed of the audio elements of the combination represented by the selection result supplied from the selection section 73. For example, the transmission request is a request to transmit the bit stream indicated by any one of the arrows A11 to A16 in FIG. 2.

In step S74, the communication section 141 transmits the transmission request, which is supplied from the request section 142 so as to transmit the bit stream, to the server 11 through the access processing section 22.

Then, the bit stream formed of audio elements of the requested combination is transmitted from the server 11, in response to the transmission request.

In step S75, the communication section 141 receives the bit stream from the server 11 through the access processing section 22, and supplies the bit stream to the audio buffer 75.

When the bit stream is received, thereafter, the processes of steps S76 and S77 and the decoding process ends. These processes are the same as the processes of steps S15 and S16 of FIG. 10, and thus the description thereof will be omitted.

As described above, the decoder 23 selects the combination of the audio elements, receives the bit stream of the selected combination from the server 11, and performs decoding. Thereby, it is possible to decode the input bit stream in various apparatuses having different hardware scales, and it is possible to reduce the transfer bit rate of the input bit stream.

Fourth Embodiment

<Configuration Example of Decoder 4>

When the audio elements of the selected combination are acquired from the server 11, the unnecessary audio elements of the combination may be made not to be transferred.

Figure 15:
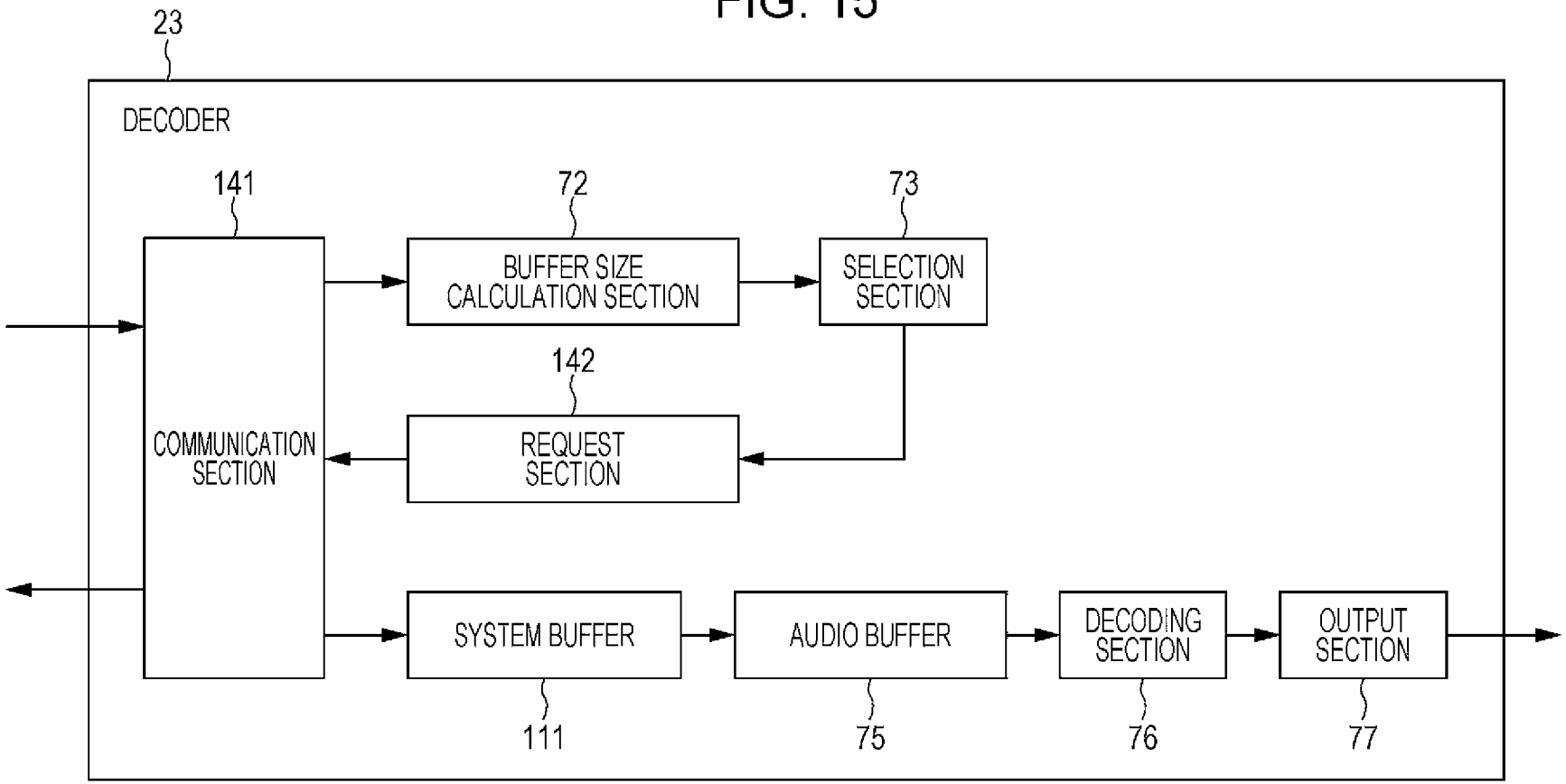
FIG. 15 is a diagram illustrating a configuration example of a decoder.

In such a case, the decoder 23 is configured, for example, as shown in FIG. 15. In addition, in FIG. 15, portions corresponding to those in the case of FIG. 11 or 13 are represented by the same reference signs and numerals, and the description thereof will be appropriately omitted.

The decoder 23 shown in FIG. 15 has the communication section 141, the buffer size calculation section 72, the selection section 73, the request section 142, a system buffer 111, the audio buffer 75, the decoding section 76, and the output section 77. In the configuration of the decoder 23 shown in FIG. 15, the system buffer 111 is further provided in addition to the configuration of the decoder 23 shown in FIG. 13.

In the decoder 23 shown in FIG. 15, the selection section 73 selects the combination of the audio elements and the unnecessary audio element not to be transferred among the audio elements constituting the combination, and supplies the selection result to the request section 142.

Here, the selection of the unnecessary audio element is performed on the basis of, for example, the priority information included in the EXT element, but the EXT element may be acquired in any method.

For example, as indicated by the arrow A21 of FIG. 3, if the EXT element is recorded in the server 11 alone, the communication section 141 acquires the EXT element from the server 11 through the streaming control section 21 at arbitrary timing before the start of decoding. Then, the communication section 141 supplies the EXT element to the selection section 73 through the buffer size calculation section 72.

Further, for example, as indicated by the arrow A22 of FIG. 3, if the EXT element is assigned to the frame head of the input bit stream, the communication section 141 first receives the EXT element, which is present in the head portion of the input bit stream, from the server 11, and supplies the EXT element to the buffer size calculation section 72. Then, the buffer size calculation section 72 supplies the EXT element, which is received from the communication section 141, to the selection section 73.

Hereinafter, the description will be continued under the following assumption: as indicated by the arrow A21 of FIG. 3, the EXT element is recorded in the server 11 alone.

The request section 142 supplies the transmission request to the communication section 141, on the basis of the selection result supplied from the selection section 73. The transmission request is a request to transmit the bit stream formed of the audio elements which constitute the selected combination and will not be transferred.

The size information is supplied from the communication section 141 to the system buffer 111.

For example, as indicated by the arrow A31 of FIG. 7, if the size information is recorded in the server 11 alone, the communication section 141 acquires the size information from the server 11 through the streaming control section 21 at arbitrary timing before the start of decoding, and supplies the information to the system buffer 111.

Further, for example, as indicated by the arrow A32 or the arrow A33 of FIG. 7, if the size information is assigned to the head of the frames or is assigned to the head of the audio elements, the communication section 141 supplies the input bit stream received from the server 11, more specifically, a part of each divided input bit stream to the system buffer 111.

In addition, as indicated by the arrow A33 of FIG. 7, if the size information is assigned to the head of the audio elements, the bit stream of the audio elements, which are set not to be transferred, in the combination selected by the selection section 73 includes only the size information.

The system buffer 111 performs the buffer control through the above-mentioned transfer bit rate adjustment process RMT(1) or RMT(2), on the basis of the size information, and supplies the audio elements, which are supplied from the communication section 141, to the audio buffer 75. It should be noted that, hereinafter assuming that the transfer bit rate adjustment process RMT(1) is performed, the description will be continued.

<Description of Decoding Process 4>

Figure 16:
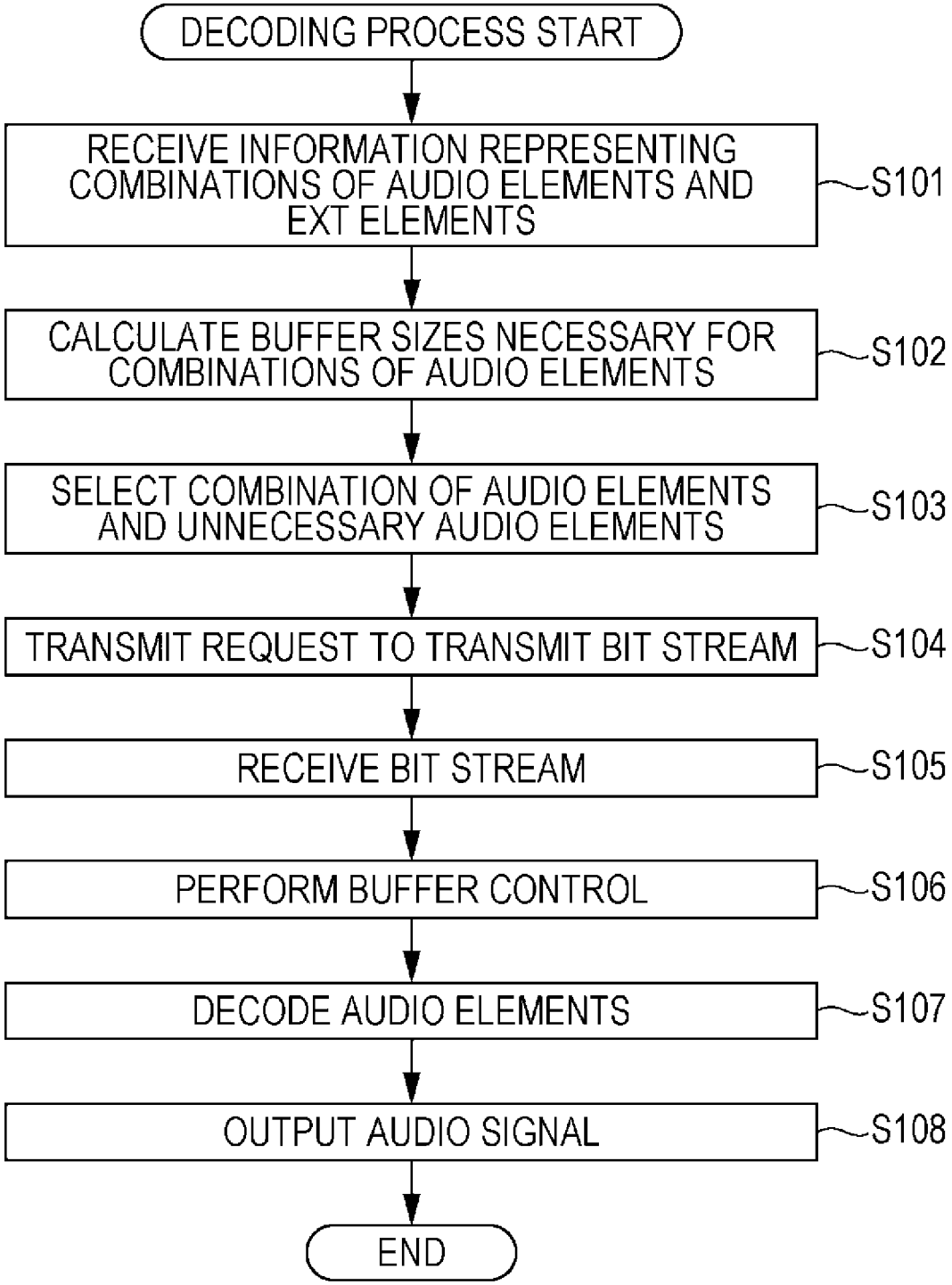
FIG. 16 is a flowchart illustrating a decoding process.

Next, referring to the flowchart of FIG. 16, the decoding process performed by the decoder 23 shown in FIG. 15 will be described.

In step S101, the communication section 141 receives the EXT element and the information representing the combinations of the audio elements which can be acquired from the server 11, and supplies the EXT element and the information to the buffer size calculation section 72.

That is, the communication section 141 transmits the transmission request to transmit the EXT element and the information representing the combinations of the audio elements which can be acquired, to the server 11 through the streaming control section 21. Further, the communication section 141 receives the EXT element and the information, which represents the combinations of the audio elements transmitted from the server 11, through the streaming control section 21, in response to the transmission request, and supplies the EXT element and the information to the buffer size calculation section 72. Further, the buffer size calculation section 72 supplies the EXT element, which is received from the communication section 141, to the selection section 73.

When the information representing the combinations of the audio elements are acquired, the audio elements necessary to be transferred are selected through the processes of steps S102 and S103. However, the processes are the same as the processes of steps S42 and S43 of FIG. 12, and thus the description thereof will be omitted.

Here, in step S102, the necessary buffer sizes are calculated on the basis of the information representing the combinations of the audio elements. In step S103, the selection result obtained by the selection section 73 is supplied to the request section 142.

Further, the request section 142 supplies the transmission request to the communication section 141, on the basis of the selection result supplied from the selection section 73. The transmission request is a request to transmit the bit stream formed of the audio elements which constitute the selected combination and will not be transferred. In other words, it is necessary for the audio elements of the selected combination to be transmitted, and it is necessary for the unnecessary audio element, which is selected not to be a decoding target, in the combination not to be transferred.

In step S104, the communication section 141 supplies the transmission request to the server 11 through the access processing section 22. The transmission request is supplied from the request section 142, and is a request to transmit the bit stream formed of the audio elements which constitute the selected combination and will not be transferred.

Then, in response to the transmission request to transmit the bit stream, the bit stream is transmitted from the server 11. The bit stream is formed of audio elements which constitute the requested combination and are set to be transferred.

In step S105, the communication section 141 receives the bit stream from the server 11 through the access processing section 22, and supplies the bit stream to the system buffer 111.

When the bit stream is received, thereafter, the processes of steps S106 to S108 and the decoding process ends. These processes are the same as the processes of steps S45 to S47 of FIG. 12, and thus the description thereof will be omitted.

As described above, the decoder 23 selects the combination of the audio elements, and selects the unnecessary audio element, which is not a decoding target, on the basis of the priority information. Thereby, it is possible to decode the input bit stream in various apparatuses having different hardware scales, and it is possible to reduce the transfer bit rate of the input bit stream. Further, by performing the buffer control, decoding at the minimum decoder input buffer size can be performed.

However, the above-mentioned series of process may be performed by hardware, and may be performed by software. When the series of process is performed by software, the programs constituting the software are installed in a computer. Here, the computer includes a computer built in the dedicated hardware and for example a general personal computer or the like capable of performing various functions by installing various programs.

Figure 17:
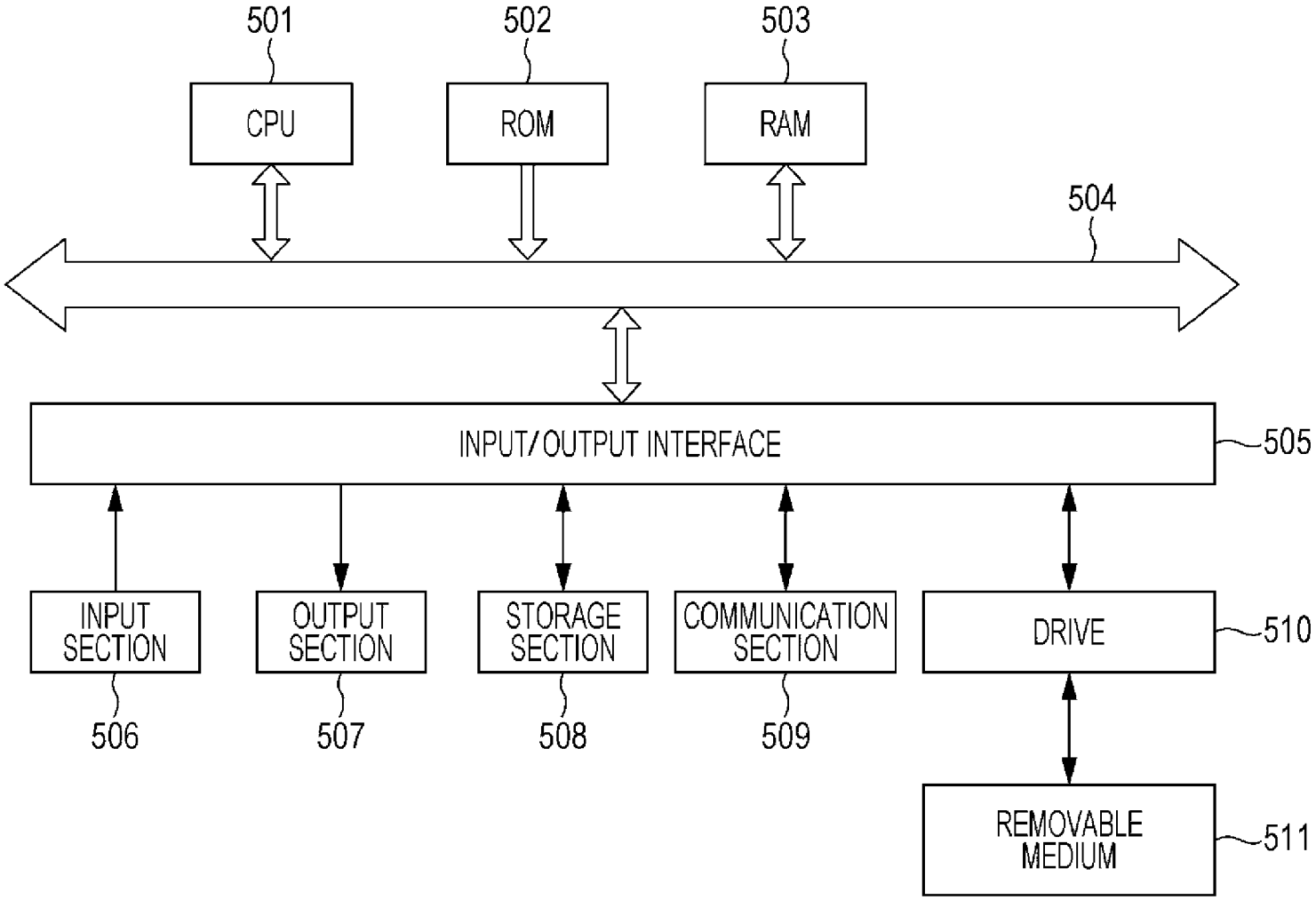
FIG. 17 is a diagram illustrating a configuration example of a computer.

FIG. 17 is a block diagram illustrating an exemplary configuration of the hardware of the computer which performs the above-mentioned series of process through a program.

In the computer, a central process unit (CPU) 501, a read only memory (ROM) 502, and a random access memory (RAM) 503 are connected to each other through a bus 504.

The bus 504 is further connected to an input/output interface 505. The input/output interface 505 is connected to an input section 506, an output section 507, a storage section 508, a communication section 509, and a drive 510.

The input section 506 is formed of a keyboard, a mouse, a microphone, an imaging element, and the like. The output section 507 is formed of a display, a speaker, and the like. The storage section 508 is formed of a hard disk, a non-volatile memory, and the like. The communication section 509 is formed of a network interface and the like. The drive 510 drives a removable medium 511 such as a magnetic disk, an optical disc, a magneto-optical disk, or a semiconductor memory.

In the computer configured as described above, for example, the CPU 501 loads and executes the program, which is stored in the storage section 508, in the RAM 503 through the input/output interface 505 and the bus 504, thereby performing the above-mentioned series of process.

The program executed by the computer (the CPU 501) can be provided in a state where the program is stored in the removable medium 511 such as a package medium. Further, the program is provided through a wired or wireless transmission medium such as a local area network, the Internet, or a digital satellite broadcast.

In the computer, the program can be installed in the storage section 508 through the input/output interface 505 by mounting the removable medium 511 in the drive 510. Further, the program can be installed in the storage section 508 by allowing the communication section 509 to receive the program through the wired or wireless transmission medium. Besides, the program can be installed in advance in the ROM 502 or the storage section 508.

In addition, the program executed by the computer may be a program which chronologically performs the process in order of description of the present specification, and may be a program which performs the process in parallel or at necessary timing such as the timing of calling.

The embodiments of the present technology are not limited to the above-mentioned embodiments, and may be modified into various forms without departing from the technical scope of the present technology.

For example, in the present technology, it is possible to adopt a cloud computing configuration in which a single function is shared and cooperatively processed by a plurality of devices through a network.

Further, the steps described in the above-mentioned flowchart are not only executed by a single device, but may also be shared and executed by a plurality of devices.

Furthermore, when a plurality of processes is included in a single step, the plurality of processes included in the single step is not only executed by a single device, but may also be shared and executed by a plurality of devices.

Some embodiments may comprise a non-transitory computer readable storage medium (or multiple non-transitory computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage media) encoded with one or more programs (e.g., a plurality of processor-executable instructions) that, when executed on one or more computers or other processors, perform methods that implement the various embodiments discussed above. As is apparent from the foregoing examples, a non-transitory computer-readable storage medium may retain information for a sufficient time to provide computer executable instructions in a non-transitory form.

The present technology may have the following configurations.

<1>

A decoding device including: a selection section that selects one combination of audio elements on the basis of buffer sizes each of which is determined for each combination of the audio elements and each of which is necessary for decoding of the audio elements of the combination; and a generation section that generates an audio signal by decoding the audio elements of the selected combination.

<2>

The decoding device according to <1>, in which the selection section selects one combination from a plurality of the combinations which is provided in advance for the same contents.

<3>

The decoding device according to <2> or any other preceding configuration, further including a communication section that receives a bit stream of the combination selected by the selection section among bit streams each of which is provided for each of the plurality of the combinations and each of which is constituted of the audio elements of each combination.

<4>

The decoding device according to <1> or <2> or any other preceding configuration, in which the selection section selects several audio elements among the plurality of the audio elements constituting a bit stream, as one combination.

<5>

The decoding device according to <4> or any other preceding configuration, in which the selection section selects one combination on the basis of meta data of the bit stream.

<6>

The decoding device according to <5> or any other preceding configuration, in which the selection section selects one combination on the basis of at least either one of information, which represents the plurality of the combinations determined in advance as the meta data, and priority information of the audio elements.

<7>

The decoding device according to any one of <4> to <6> or any other preceding configuration, further including an extraction section that extracts the audio elements of the combination, which is selected by the selection section, from the bit stream.

<8>

The decoding device according to any one of <4> to <6> or any other preceding configuration, further including a communication section that receives the audio elements of the combination which is selected by the selection section.

<9>

The decoding device according to <5> or any other preceding configuration, further including a buffer control section that controls storage of the audio elements, which are decoded by the generation section, into a buffer, on the basis of the sizes of the audio elements which are not selected as decoding targets.

<10>

The decoding device according to <9> or any other preceding configuration, in which the selection section further selects the audio elements, which are not selected as decoding targets, from the audio elements constituting the selected combination, and in which the buffer control section controls storage of the audio elements other than the audio elements, which constitute the combination selected by the selection section and are not decoding targets, into the buffer, on the basis of the sizes of the audio elements which are selected by the selection section and are not decoding targets.

<11>

The decoding device according to <10> or any other preceding configuration, in which the selection section selects the audio elements which are not decoding targets, on the basis of the priority information of the audio elements.

<12>

A decoding method including: selecting one combination of audio elements on the basis of buffer sizes each of which is determined for each combination of the audio elements and each of which is necessary for decoding of the audio elements of the combination; and generating an audio signal by decoding the audio elements of the selected combination.

<13>

A program causing a computer to execute processes including: selecting one combination of audio elements on the basis of buffer sizes each of which is determined for each combination of the audio elements and each of which is necessary for decoding of the audio elements of the combination; and generating an audio signal by decoding the audio elements of the selected combination.

<14>

A decoding device, comprising at least one buffer; and at least one processor configured to: select, based at least in part on a size of the at least one buffer, at least one audio element from among multiple audio elements in an input bit stream; and generate an audio signal by decoding the at least one audio element.

<15>

The decoding device according to <14>, wherein the at least one audio element comprises a set of audio elements, and wherein the at least one processor is configured to select the set of audio elements from a plurality of predetermined sets of audio elements.

<16>

The decoding device according to <15> or any other preceding configuration, further comprising a communication section configured to receive data in the input bit stream corresponding to audio elements in the set of audio elements.

<17>

The decoding device according to <14> or any other preceding configuration, wherein the at least one processor is configured to select a plurality of audio elements from among the multiple audio elements in the input bit stream.

<18>

The decoding device according to <17> or any other preceding configuration, wherein at least one processor is configured to select the plurality of audio elements further based on meta data of the input bit stream.

<19>

The decoding device according to <18> or any other preceding configuration, wherein the at least one processor is configured to select the plurality of audio elements based on at least one of information identifying a plurality of predetermined sets of audio elements and priority information of the audio elements.

<20>

The decoding device according to <17> or any other preceding configuration, wherein the at least one processor is further configured to extract the plurality of audio elements from the input bit stream.

<21>

The decoding device according to <17> or any other preceding configuration, further comprising a communication section configured to receive data in the input bit stream corresponding to audio elements in the plurality of audio elements.

<22>

The decoding device according to <18> or any other preceding configuration, further comprising a buffer controller configured to control, based on sizes of audio elements in the plurality of audio elements that are not decoded, storage into the at least one buffer of at least one decoded audio element obtained by decoding at least one of the plurality of audio elements.

<23>

The decoding device according to <22> or any other preceding configuration, wherein the at least one processor is configured to select the audio elements in the plurality of audio elements that are not decoded.

<24>

The decoding device according to <23> or any other preceding configuration, wherein the at least one processor is configured to select the audio elements in the plurality of audio elements that are not decoded based on priority information of the audio elements.

<25>

The decoding device according to <14> or any other preceding configuration, wherein the at least one processor is configured to select the at least one audio element by determining a buffer size sufficient for decoding the at least one audio element and comparing the buffer size with the size of the at least one buffer.

<26>

A decoding method, comprising: selecting, based at least in part on a size of at least one buffer of a decoding device, at least one audio element from among multiple audio elements in an input bit stream; and generating an audio signal by decoding the at least one audio element.

<27>

At least one non-transitory computer-readable storage medium storing processor-executable instructions that, when executed by at least one processor, cause the at least one processor to perform a decoding method comprising: selecting, based at least in part on a size of at least one buffer of a decoding device, at least one audio element from among multiple audio elements in an input bit stream; and generating an audio signal by decoding the at least one audio element.

It should be understood by those skilled in the art that various modifications, combinations, sub-combinations and alterations may occur depending on design requirements and other factors insofar as they are within the scope of the appended claims or the equivalents thereof.

REFERENCE SIGNS LIST

23 Decoder
71 Acquisition section
72 Buffer size calculation section
73 Selection section
74 Extraction section
75 Audio buffer
76 Decoding section
111 System buffer
141 Communication section
142 Request section

The invention claimed is:

1. A decoding device, comprising:

at least one buffer having a predetermined allowable memory size; and at least one processor configured to:

calculate a necessary buffer size for each of a plurality of combinations of audio elements in an input bit stream;

select, based at least in part on comparing the predetermined allowable memory size of the at least one buffer with each of the calculated buffer sizes of each of the combinations of audio elements in the input bit stream, a combination of audio elements from among the plurality of combinations of audio elements in the input bit stream, so that the selected combination of audio elements in the input bit stream can be decoded using the at least one buffer having the predetermined allowable memory size;

extract the selected combination of audio elements from the input bit stream;

store the extracted combination of audio elements in the at least one buffer; and generate an output audio signal by decoding the stored combination of audio elements.

2. The decoding device according to claim 1, wherein the at least one processor is configured to receive data in the input bit stream corresponding to audio elements in the plurality of combinations of audio elements.

3. The decoding device according to claim 1, wherein the at least one processor is configured to select a plurality of audio elements from among the audio elements in the input bit stream.

4. The decoding device according to claim 3, wherein at least one processor is configured to select the plurality of audio elements further based on meta data of the input bit stream.

5. The decoding device according to claim 4, wherein the at least one processor is configured to select the plurality of audio elements based on at least one of information identifying a plurality of predetermined sets of audio elements and priority information of the audio elements.

6. The decoding device according to claim 3, wherein the at least one processor is further configured to extract the plurality of audio elements from the input bit stream.

7. The decoding device according to claim 3, wherein the at least one processor is configured to receive data in the input bit stream corresponding to audio elements in the plurality of audio elements.

8. The decoding device according to claim 4, further comprising a buffer controller configured to control, based on sizes of audio elements in the plurality of audio elements that are not decoded, storage into the at least one buffer of at least one decoded audio element obtained by decoding at least one of the plurality of audio elements.

9. The decoding device according to claim 8, wherein the at least one processor is configured to select the audio elements in the plurality of audio elements that are not decoded.

10. The decoding device according to claim 9, wherein the at least one processor is configured to select the audio elements in the plurality of audio elements that are not decoded based on priority information of the audio elements.

11. A decoding method, comprising:

calculating, by a decoding device, a necessary buffer size for each of a plurality of combinations of audio elements in an input bit stream;

selecting, based at least in part on comparing a predetermined allowable memory size of at least one buffer of the decoding device with each of the calculated buffer sizes of each of the combinations of audio elements in the input bit stream, a combination of audio elements from among the plurality of combinations of audio elements in the input bit stream, so that the selected combination of audio elements in the input bit stream can be decoded using the at least one buffer having the predetermined allowable memory size;

extracting the selected combination of audio elements from the input bit stream;

storing the extracted combination of audio elements in the at least one buffer; and generating an output audio signal by decoding the stored combination of audio elements.

12. At least one non-transitory computer-readable storage medium storing processor-executable instructions that, when executed by at least one processor, cause the at least one processor to perform a decoding method comprising:

calculating, by a decoding device, a necessary buffer size for each of a plurality of combinations of audio elements in an input bit stream;

selecting, based at least in part on comparing a predetermined allowable memory size of at least one buffer of the decoding device with each of the calculated buffer sizes of each of the combinations of audio elements in the input bit stream, a combination of audio elements from among the plurality of combinations of audio elements in the input bit stream, so that the selected combination of audio elements in the input bit stream can be decoded using the at least one buffer having the predetermined allowable memory size;

extracting the selected combination of audio elements from the input bit stream;

storing the extracted combination of audio elements in the at least one buffer; and generating an output audio signal by decoding the stored combination of audio elements.

* * * * *